US009847218B2

(12) United States Patent
Remes et al.

(10) Patent No.: US 9,847,218 B2
(45) Date of Patent: Dec. 19, 2017

(54) HIGH-RESOLUTION ION TRAP MASS SPECTROMETER

(71) Applicant: Thermo Finnigan LLC, San Jose, CA (US)

(72) Inventors: Philip M. Remes, San Jose, CA (US); Jae C. Schwartz, Gilroy, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/933,961

(22) Filed: Nov. 5, 2015

(65) Prior Publication Data

US 2017/0133215 A1 May 11, 2017

(51) Int. Cl.
*H01J 49/42* (2006.01)
*H01J 49/00* (2006.01)

(52) U.S. Cl.
CPC ..... *H01J 49/429* (2013.01); *H01J 49/0031* (2013.01)

(58) Field of Classification Search
USPC ..... 250/282
See application file for complete search history.

(56) References Cited

U.S. PATENT DOCUMENTS 2,939,952 A 6/1960 Paul et al.
4,540,884 A 9/1985 Stafford et al.
4,736,101 A 4/1988 Syka et al.
5,285,063 A * 2/1994 Schwartz ..... H01J 49/424 250/282
5,347,127 A 9/1994 Franzen
6,624,411 B2 * 9/2003 Umemura ..... G01N 23/046 250/282
6,847,037 B2 * 1/2005 Umemura ..... H01J 49/428 250/292

(Continued)

FOREIGN PATENT DOCUMENTS

EP 2738788 A2 6/2014

OTHER PUBLICATIONS

Proakis et al., "Digital Signal Processing: Principles, Algorithms, and Applications" (Prentice Hall, 1994), 4th edition, 2007, Chapter 2.6, pp. 116-128.

(Continued)

*Primary Examiner* — Phillip A Johnston
(74) *Attorney, Agent, or Firm* — David A. Schell; Charles B. Katz; Kilpatrick Townsend

(57) ABSTRACT

Techniques can increase the resolution and accuracy of mass spectra obtained using ion traps through the use of the actual shape of the ion trap peaks, which is a series of smaller ion ejection events. The peak shapes are identified as changing over a common period of the trapping signal and the excitation signal, at which point the peak shapes repeat. Peak shapes can be characterized over the common period to create N basis functions, each for a different fractional mass for a given scan rate. The N basis functions over the common period can be duplicated (e.g., shifted by the common period) to obtain a set of mass functions that characterize fractional masses over the full scan range. The mass spectrum can be obtained by fitting the set of mass functions to the measured data to obtain a best fit contribution of each mass function to the measured data.

5 Claims, 17 Drawing Sheets

(56) References Cited

U.S. PATENT DOCUMENTS

| | | | | |
|---|---|---|---|---|
| 8,389,929 | B2 * | 3/2013 | Schoen | H01J 49/26 250/281 |
| 9,048,074 | B2 * | 6/2015 | Senko | H01J 49/0081 |
| 9,190,255 | B2 * | 11/2015 | Raptakis | H01J 49/067 |

OTHER PUBLICATIONS

Remes, et al., Re-print of "Insight into the Resonance Ejection Process during Mass Analysis through Simulations for Improved Linear Quadrupole Ion Trap Mass Spectrometer Performance", IJMS 377 (2015), pp. 368-384.

Julian, Jr. et al., "Large scale simulation of mass spectra recorded with a quadrupole ion trap mass spectrometer". International Journal of Mass Spectrometry and Ion Processes, 123 (1993), pp. 85-96.

* cited by examiner

Sample $$As = y$$

$$\begin{bmatrix} x_{\phi(t_0)} & x_{\phi(t_1)} & \cdots & x_{\phi(k)} \end{bmatrix} \begin{bmatrix} s_1 \\ s_2 \\ \vdots \\ s_k \end{bmatrix} = [y]$$

$$A^t A s = A^t y$$

$$\begin{bmatrix} x^t_{\phi(t_0)} \\ x^t_{\phi(t_1)} \\ \vdots \\ x^t_{\phi(t_k)} \end{bmatrix} \begin{bmatrix} x_{\phi(t_0)} & x_{\phi(t_1)} & \cdots & x_{\phi(t_k)} \end{bmatrix} \begin{bmatrix} s_1 \\ s_2 \\ \vdots \\ s_k \end{bmatrix} = \begin{bmatrix} x^t_{\phi(t_0)} \\ x^t_{\phi(t_1)} \\ \vdots \\ x^t_{\phi(t_k)} \end{bmatrix} [y]$$

1210

$$\begin{bmatrix} x^t_{\phi(t_0)} x_{\phi(t_0)} & x^t_{\phi(t_0)} x_{\phi(t_1)} & \cdots & x^t_{\phi(t_0)} x_{\phi(t_k)} \\ x^t_{\phi(t_1)} x_{\phi(t_0)} & x^t_{\phi(t_1)} x_{\phi(t_1)} & \cdots & x^t_{\phi(t_1)} x_{\phi(t_k)} \\ \vdots & \vdots & \ddots & \vdots \\ x^t_{\phi(t_k)} x_{\phi(t_0)} & x^t_{\phi(t_k)} x_{\phi(t_1)} & \cdots & x^t_{\phi(t_k)} x_{\phi(t_k)} \end{bmatrix} \begin{bmatrix} s_1 \\ s_2 \\ \vdots \\ s_k \end{bmatrix} = \begin{bmatrix} x^t_{\phi(t_0)} y \\ x^t_{\phi(t_1)} y \\ \vdots \\ x^t_{\phi(t_k)} y \end{bmatrix}$$

1220

1230

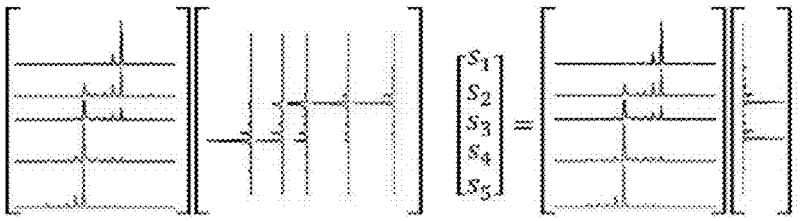

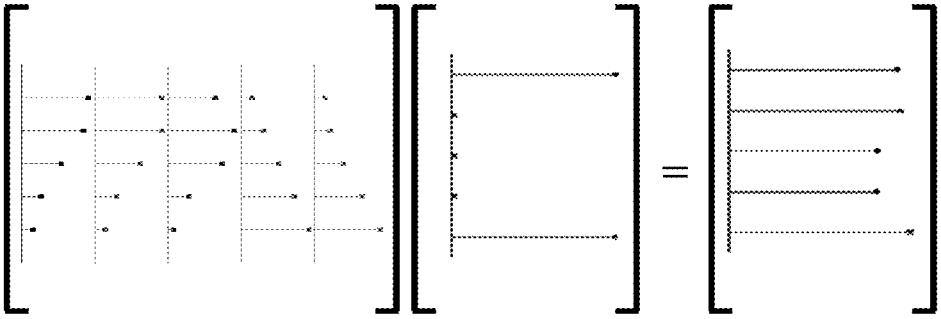

*FIG. 12*

HIGH-RESOLUTION ION TRAP MASS SPECTROMETER

BACKGROUND

Ion trap mass spectrometers, or quadrupole ion stores, have been known for many years. Ions are formed and contained within a physical structure by means of electrostatic fields, such as DC and AC, e.g., radiofrequency (RF), and a combination thereof. In general, a quadrupole electric field provides an ion storage region by the use of a hyperbolic electrode structure or other electrode structure that provides an equivalent quadrupole trapping field.

The storage of ions in an ion trap is achieved by operating trap electrodes with a time-varying trapping electric field having a trapping amplitude and a trapping frequency, a DC voltage, and device sizes such that ions having mass-to-charge ratios within a finite and useful range are stably trapped inside the device. The aforementioned parameters are sometimes referred to as trapping parameters and from these one can determine the range of mass-to-charge ratios that will permit stable trajectories and the successful trapping of ions.

For stably trapped ions, ion motion may be described as an oscillation containing innumerable frequency components, the first component (or secular frequency) being the most important and of the lowest frequency, and each higher frequency component contributing less than its predecessor. For a given set of trapping parameters, trapped ions of a particular mass-to-charge ratio will oscillate with a distinct secular frequency that can be determined from the trapping parameters by calculation.

In an early method of ion trap operation, the "mass-selective instability mode" (described in U.S. Pat. No. 4,540,884), a mass spectrum is recorded by scanning the trapping amplitude whereby ions of successively increasing m/z are caused to adopt unstable trajectories and to exit the ion trap, where they are detected by an externally mounted detector. The presence of a light buffer gas such as helium at a pressure of approximately $1.3\times10^{-1}$ Pa was also shown to enhance sensitivity and resolution in this mode of operation.

Although the mass-selective instability mode of operation was successful, another method of operation, the "mass-selective instability mode with resonance ejection" (described in U.S. Pat. No. 4,736,101) proved to have certain advantages, such as the ability to record mass spectra containing a greater range of abundances of the trapped ions. A supplementary (excitation) field is applied across the end cap electrodes and the trapping amplitude is scanned to bring ions of successively increasing m/z into resonance with the excitation field, whereby the ions are ejected and detected to provide a mass spectrum.

The mass resolution of the ion trap mass spectrometer can be improved by scanning in such a way that ions are brought into resonance, ejected, and detected is at a rate such that the time interval between the ejection of successive m/z values is large (e.g., at least 200 times the period of the excitation (resonance) frequency). This technique has allowed the ion trap to be used to distinguish isobaric ions and to resolve peaks due to multiply charged ions of successive masses. Although the resonance ejection enhancement of the mass selective instability scan allows an increased mass range and mass resolution, the scan rate is slow and resolving fractional difference in masses is difficult.

U.S. Pat. No. 5,347,127 to Franzen purported to improve the scan rate for devices having a non-linear field resonance, but in effect only ejected ions at 1 Th intervals. The trapping frequency and the excitation frequency were made to be integer fractions of each other. The scan rate was chosen such that a specified integer number of cycles (e.g., 7) of the excitation frequency were used to analyze each mass change of 1 Th. But, a resolution of a fraction of a Th was not achieved or even attempted.

It is therefore desirable to have improved methods of fast scan rates while maintaining high resolution or higher resolution at current scan rates

BRIEF SUMMARY

Embodiments of the present invention can increase the resolution and accuracy of mass spectra obtained using ion traps through the use of signal processing techniques that utilize the actual shape of the ion trap peaks, which is a series of smaller ion ejection events (subpeaks). The peak shapes are identified as changing over a common period of the trapping signal and the excitation signal, at which point the peak shapes repeat. The peak shapes can be characterized over the common period to create N basis functions, each for a different fractional mass for a given scan rate. The N basis functions over the common period can be duplicated (e.g., shifted by the common period) to obtain a set of mass functions that characterize fractional masses over the full scan range. The mass spectrum can be obtained by fitting the set of mass functions to the measured data so as to obtain a best fit contribution of each mass function to the measured data.

In accordance with another embodiment, a method is provided for mass analyzing ions in an ion trap. The method involves mass sequentially ejecting ions from a trap volume to a detector by applying a resonant excitation signal to the ion trap, and progressively scanning the trapping signal amplitude over time. During the mass scan, at least one of: (i) a scan starting time, (ii) a frequency of the resonant excitation signal or the trapping signal, or (iii) a phase of the resonant excitation signal or the trapping signal, is or are controlled to cause ions of a particular m/z to be ejected to the detector in a reproducible pattern of plural micropulses. The detector responsively generates a plurality of measurement points extending over a time range, each measurement point representing an intensity of ejected ions detected at a discrete timepoint, and is operated at a data acquisition frequency sufficiently high to resolve adjacent micropulses. A mass spectrum of the ions is constructed based on a determination of a linear combination of stored micropulse patterns that approximates the plurality of measurement points. Each of the stored micropulse patterns corresponds to an ion of a particular m/z, and the stored micropulse patterns define a repeating sequence over an m/z interval.

Other embodiments are directed to systems and computer readable media associated with methods described herein.

A better understanding of the nature and advantages of embodiments of the present invention may be gained with reference to the following detailed description and the accompanying drawings.

BRIEF DESCRIPTION OF THE DRAWINGS

FIG. 12 shows a technique using matrix multiplications of mass functions to determine an abundance of ions in a detected signal from an ion trap device according to embodiments of the present invention.

TERMS

Figure 1:
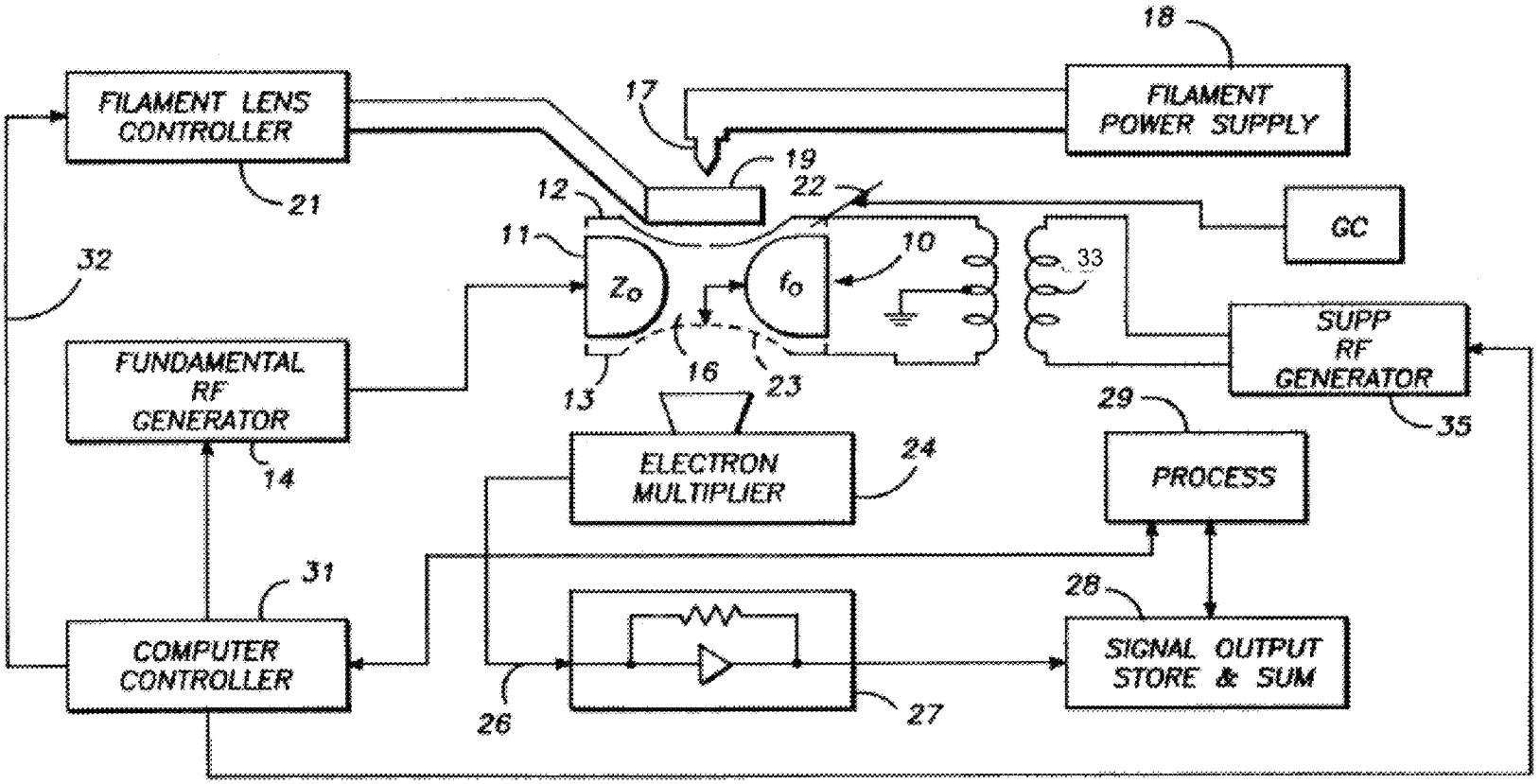
FIG. 1 is a simplified schematic of a quadrupole ion trap mass spectrometer along with a block diagram of associated electrical circuits for operating the mass spectrometer according to embodiments of the present invention.

A "spectrum" of a sample corresponds to a set of data points, where each data point includes at least two values. A first value of the spectrum corresponds to a discriminating parameter of the spectrum, such as a mass, time, or frequency. The parameter is discriminating in that the particles are differentiated in the spectrum based on values for the parameter. A second value of the spectrum corresponds to an amount of particles measured from the sample that have the first value for the parameter. For instance, a spectrum can provide an amount of ions having a particular mass-to-charge ratio (also sometimes referred to as "mass"). The sample can be any substance or object from which ions are detected.

A ion trap device is a mass spectrometer that traps ions in a time-varying electric field by applying a trapping signal to electrodes of the ion trap device. The trapping signal has a trapping amplitude and a trapping frequency. An excitation signal can be applied to eject ions sequentially when the trapping amplitude or frequency is changed (scanned). The excitation signal has an excitation amplitude and a excitation frequency. A phase shift corresponds to the phase difference between the waveforms of the trapping signal and the excitation signal at a particular point, e.g., a time difference between when the excitation signal is at a maximum voltage and the closest point where the trapping signal is at a maximum voltage. The phase shift would be zero if the maximum voltages coincide for at least one point in the trapping period.

A "scan" refers to a process of varying parameters of a mass analyzer, e.g., changing the trapping amplitude for the ion trap. The settings of the parameters can be changed any number of times, with the settings being constant for one time period and changing from one time period to another. The settings may change at a particular rate (a scan rate). One or more parameters can change from one time period to another. During a scan, ions are caused to impinge upon a detector and intensities are measured at various times along the scan. For example, ions of a particular mass can be ejected and detected by an external detector outside of the ion trap. A measurement point comprises an intensity measured at a particular time, where measurement occurs at a data acquisition rate to form a detection vector of intensity values.

A "mass function" corresponds to expected spectrometry data for an ion with a given value for the mass, which may be expressed as a fraction of a Dalton. For example, different mass functions would correspond to ions having different mass-to-charge ratios, which would be ejected at different times of a scan. Using more mass functions can provide greater resolution in the resulting spectrum. A "set of mass functions" can span a mass range of a scan, where the mass functions have a shape that repeats after a common period of the trapping signal and the excitation signal. The mass functions within the common period comprise a "subset of basis functions," where the subset is repeated to provide the "set of mass functions." Each basis function of a subset corresponds to a different time offset within the common period. An "initial subset of basis functions" can be determined and used to generate the set of mass functions by shifting the initial subset of basis functions by various multiples of the common period so as to span the mass range of the scan. The absolute time during a scan can be considered a difference between a mass function and a basis function, as the basis functions are defined with respect to the common period, whereas the mass functions are defined with respect to an absolute time of the scan.

A "peak" corresponds to measurements of ions of a particular mass, as the ions are ejected over a period of time. The ions are ejected in micropackets at specific times based on a relationship of the trapping signal and the excitation signal, where the ejection events form subpeaks. A peak has a shape pattern based on the amount of ions (size of a micropacket) ejected at the specific times and when those specific times occur, i.e., a shape pattern of the subpeaks. A shape pattern for ions of a particular mass corresponds to a mass function.

A "composition vector" corresponds to determined contributions of each mass function to the detected data, i.e., the detection vector. As examples, the composition vector can be determined using direct matrix solutions or by optimization of a cost function (e.g., an error between the detection vector and values for contributions of the mass functions).

The term "optimal" refers to any value that is determined to be numerically better than one or more other values. For example, an optimal value is not necessarily the best possible value, but may simply satisfy a criterion (e.g. a change in a cost function from a previous value is within tolerance). Thus, the optimal solution can be one that is not the very best possible solution, but simply one that is better than another solution according to a criterion.

DETAILED DESCRIPTION

The fact that ion trap mass spectrometer peak shapes are made up of multiple ejection events is not widely recognized, because typically the bandwidth of the detection system and sampling rate is sufficiently low that the peaks appear somewhat Gaussian shaped. When the bandwidth of the detection system and the data is sampled at a higher rate, the multiple ejection events can be seen to form a pattern of subpeaks (also called a micropacket pattern). Embodiments have identified the micropacket patterns as repeating (e.g., repeating after a certain period of time) based on phase relationships between the trapping signal and the excitation signal. The micropacket patterns are mass functions of a model to which the detected data can be fit, thereby providing a mass spectrum with high resolution and accuracy.

For example, some embodiments can use a quadrupole ion trap (QIT) mass spectrometer with trapping voltage frequency $\Omega$ and excitation voltage frequency $\omega$, having respective periods $p_\Omega$ and $p_\omega$ that are related via a lowest common period $p_c$. The micropacket pattern of ions of a particular mass is dependent on the common phase $\phi(t)=2\pi/p_c(t-t_0)+\phi_0$ of the common waveform $f(t)=\cos(\phi(t))$ at the time when ions of a particular mass are ejected. Thus, the common phase and the micropacket pattern can be made to be a function of the mass to be analyzed, such that as the ion trap is scanned, the ions of a particular mass m always experience the same set of motions during ejection. The micropacket pattern for mass m can be used as a mass function for detection of ions of mass m, since the micropacket pattern can be the same for each scan.

Due to the physics of the ion trap, each mass ejected during a common period $p_c$ has a different micropacket pattern, since the different masses would begin ejection at different phases. The masses ejected during a common period $p_c$ can be fractional masses, and N (e.g., 20-100) micropacket patterns can be determined for the common period $p_c$. These micropacket patterns can form a subset of N basis functions, where the mass resolution is dependent on N, the scan rate, and the common period $p_c$. Each basis function in the subset would correspond to a different mass, where the resolution can be made better by measuring micropacket patterns for more phases. These subsets of N basis functions can be repeated to obtain mass functions for the scan range.

The basis functions characterizing the micropacket patterns can be stored in a library $x_{\phi(lT_S)}[n]$, where n is the digital time unit, l is a discrete time delay, and $T_S$ is the sampling period. When the conditions are met for a same mass having a same phase of the common period (e.g., by using a same ramp rate that starts with a same initial phase and initial trapping amplitude), enhanced detection of ion trap mass spectral signals can be performed, using the cross correlation $r_{yx_{\phi(lT^S)}}[l]$ of the acquired data stream y[n] with the peak shape library $x_{\phi(lT_S)}[n]$. This operation and the subsequent decomposition of the cross correlation into library signal components can be succinctly described using linear algebra. Techniques for minimization of the error between input data and a signal model can be utilized for peak detection and parameter estimation.

Accordingly, this disclosure describes signal processing techniques and experimental procedures that utilize the micropacket patterns of the ion trap peak signals. By characterizing the peak shapes over that period, and operating the instrument in such a way that the peak shape at a given m/z stays constant, cross correlation of the input data against the model peak shape can be performed, which can facilitate the extraction of low S/N signals. Higher resolution and increased peak parameter accuracy and precision over the current methods can also be achieved.

I. Ion Trap with Excitation Ejection

The operation of an ion trap using resonance ejection at an excitation frequency is described first. A later section will describe how micropacket patterns are utilized to enhance mass spectral performance.

A. System

FIG. 1 is a simplified schematic of a quadrupole ion trap mass spectrometer along with a block diagram of associated electrical circuits for operating the mass spectrometer according to embodiments of the present invention. FIG. 1 shows a three-dimensional ion trap 10 that includes a ring electrode 11 and two end caps 12 and 13 facing each other. A radio frequency voltage generator 14 is connected to ring electrode 11 to supply a radiofrequency (RF) voltage V sin($\Omega$t), which is the fundamental (trapping) signal, between end caps 12 and 13 and ring electrode 11. Application of the trapping signal provides a substantially quadrupole field for trapping ions within a trapping volume 16. The field required for trapping is formed by coupling the RF voltage between ring electrode 11 and the two end-cap electrodes 12 and 13, which are common mode grounded through coupling transformer 33. A supplementary RF generator 35 is coupled to end caps 12 and 13 to apply an excitation signal for supplying an excitation field between the end caps. In various embodiments, a hyperbolic electrode structure, a spherical, or other electrode structures can be used.

In some embodiments, a filament 17, which is fed by a filament power supply 18, provides an ionizing electron beam for ionizing the sample molecules introduced into trapping volume 16. A cylindrical gate lens 19 is powered by a filament lens controller 21. This lens gates the electron beam on and off as desired. End cap 12 includes an aperture through which the electron beam projects. In other embodiments, rather than forming the ions by ionizing samples within trapping volume 16 with an electron beam, ions can be formed externally of the trap and injected into the trap by a mechanism similar to that used to inject electrons. In FIG. 1, therefore, the external source of ions would replace the filament 17; and ions, instead of electrons, are gated into trapping volume 16 by gate lens 19.

An appropriate potential and polarity are used on gate lens 19 in order to focus ions through the aperture in end-cap 12 and into the trap. The external ionization source can employ, for example, electron ionization, chemical ionization, cesium ion desorption, laser desorption, electrospray, thermospray ionization, particle beam, and any other type of ion source. The external ion source region can be differentially pumped with respect to the trapping region.

End cap 13 has a perforated region 23 to allow unstable ions in the fields of the ion trap to exit and be detected by an electron multiplier 24, which generates an ion signal on line 26. An electrometer 27 converts the signal on line 26 from current to voltage. The signal is summed and stored by the unit 28 and processed in unit 29. The resulting signal provides a plurality of measurement points, each providing an intensity value at a particular time of the scan.

Controller 31 is connected to fundamental RF generator 14 to allow the magnitude (amplitude) and/or frequency of the fundamental RF voltage to be scanned to bring successive ions towards resonance with the excitation field applied across the end caps for providing mass selective ejection. Controller 31 is also connected to supplementary RF generator 35 to allow the magnitude and/or frequency of the excitation RF voltage to be controlled. Controller 31 is also connected (via line 32) to filament lens controller 21 to gate, into the trap, the ionizing electron beam or an externally formed ion beam before scanning. Other mechanical details of ion traps are described in U.S. Pat. Nos. 2,939,952; 4,540,884; 4,736,101; and 5,285,063, which are incorporated by reference.

In various embodiments, ion trap are so called "two dimensional" or "linear ion traps" versus a "three dimensional". The dimensionality refers to the number of dimensions that the main trapping RF field exists In the implementation of a three dimensional trap, the trapping field comprises a time-varying field that exists in three dimensions. In a two dimensional implementation, the trapping field comprises a constant field (e.g., by application of a DC voltage) in one direction and a time-varying field (e.g., by application of an AC voltage) in the other two dimensions. A significant advantage can be obtained by the latter implementation in two dimensions, where more ions can generally be trapped and analyzed without incurring space charge effects. With this two-dimensional embodiment, an elongation of the trapping space is made possible resulting in a cylinder of ions, as opposed to a sphere, and therefore a higher capacity for ions. Further, it is quite beneficial to not have to penetrate an RF field when injecting ions into the device, instead injecting ions along the axis of the DC field, which minimizes losses of ions. In a typical two-dimensional ion trap of the radial-ejection type, the ion trap consists of four elongated electrodes arranged into two electrode pairs, with each electrode pair being opposed across and aligned with the trap axial centrerline. The trapping field is established by applying opposite phases of an RF voltage (the trapping signal) to the two electrode pairs, and a dipole oscillatory voltage (the resonant excitation signal) is applied across one of the electrode pairs to eject ions through one or more apertures formed in the electrode pair across which the oscillatory voltage is applied. DC voltages may be applied to outer segments of the elongated electrodes, or to plate lenses positioned axially outwardly of the electrode, to generate a potential well to confine ions in the axial dimension. The construction, theory and operation of two-dimensional ion traps are discussed extensively in the literature (see, e.g., Schwartz et al., "A Two-Dimensional Quadrupole Ion Trap Mass Spectrometer", J. Am. Soc. Mass Spectrometry, 13: 659-669 (2002), the disclosure of which is incorporated herein by reference).

The ion trap detector, which generates a signal representative of the abundance of ions ejected from the ion trap at discrete timepoints, is coupled to a data system (also referred to herein as a computer system) which processes the detector signal in accordance with methods described below to generate a mass spectrum.

B. Method of Ejection

Figure 2:
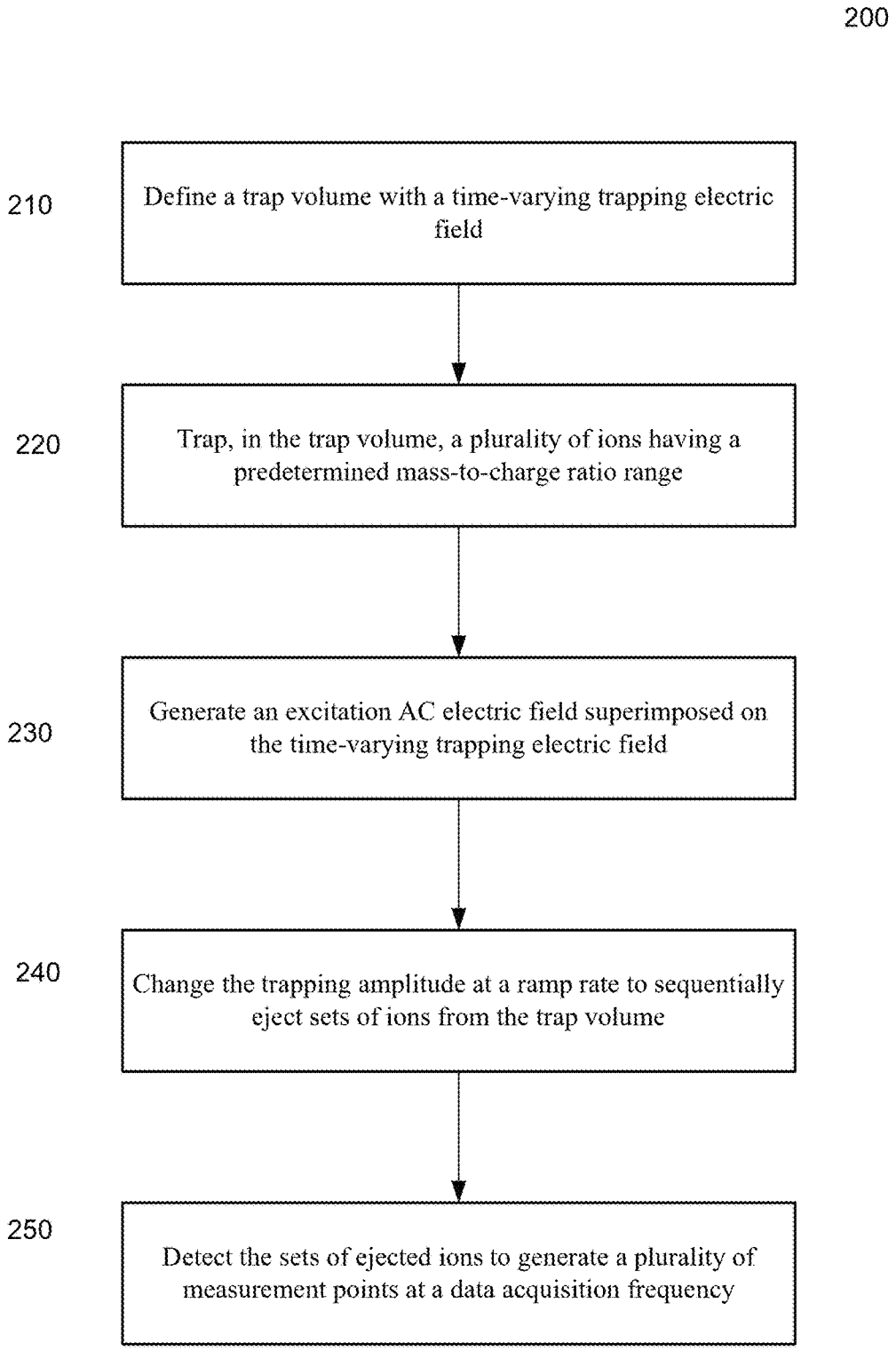
FIG. 2 is a flowchart illustrating a method 200 of operating an ion trap according to embodiments of the present invention.

FIG. 2 is a flowchart illustrating a method 200 of operating an ion trap according to embodiments of the present invention. The ion trap can be operated to detect ions from a sample. The detected ions can be analyzed to obtain a mass spectrum of the sample so as to measure a composition of the sample.

At block 210, a trapping electric field is applied to a trapping device and is used to define a trap volume. The trapping electric field is time-varying. Ions within a predetermined range of mass-to-charge ratio can be trapped within the trap volume. The trap volume is located within electrodes of an ion trap device. The trapping electric field can be generated by applying a trapping signal to the ion trap device, e.g., to various electrodes of the ion trap, where the electrodes can have various shapes. The trapping signal has a trapping amplitude and a trapping frequency.

At block 220, a plurality of ions having the predetermined mass-to-charge ratio range are trapped in the trap volume. The plurality of ions can be obtained from the sample in a variety of ways. In some embodiments, the ions can be generated first and then injected into the trapping volume. In other embodiments, the ions can be formed within the trapping volume, e.g., by inserting molecules and then ionizing them in the trapping volume.

At block 230, the ion trap device generates an excitation electric field superimposed on the trapping electric field. The excitation electric field is generated by applying an excitation signal to the ion trap device, where the excitation signal has an excitation frequency and amplitude. As described in later sections, the trapping frequency and the excitation frequency can be related by a ratio of integers.

At block 240, the trapping amplitude is changed at a ramp rate to sequentially eject sets of ions from the trap volume. Each set of ions corresponds to a particular mass-to-charge ratio. A set of ions is ejected when a component of the frequency of motion of the set of ions are in resonance with the excitation frequency. As the trapping amplitude increases, the ions' secular frequency of motion increases. The frequency of motion is dependent on mass (specific to the mass-to-charge ratio), with lighter ions having a higher frequency than heavier ions. When the secular frequency of motion of ions of a particular mass equals the excitation frequency, the ions are in resonance with the excitation electric field and are ejected. Different sets of ions may be ejected at overlapping times, although ions of a particular mass will have a different ejection pattern than ions of a different mass, even if different by a fraction of a Dalton.

Accordingly, ions of different masses are ejected at different times, and the time of ejection corresponds to the mass of the ejected ions. The ramp rate can be set at a certain rate that controls how fast the ions are ejected. A higher ramp rate causes ions across a specific mass range to be ejected faster. Or, for a specific time interval over which the ramping occurs, a higher ramp rate would eject a larger range of masses.

At block 250, a detection system detects the sets of ions that are ejected from the trap volume to generate a plurality of measurement points. The detector can operate at a data acquisition frequency, which as described below, can be greater than the trapping frequency. Each measurement point includes an intensity value and a time value. The intensity value corresponds to an amount of ions detected at the time value. Thus, if a sample includes more ions of a particular mass, then the corresponding peak will be larger. The plurality of measurement points are obtained over a time range (i.e., over which a scan is performed). The intensity values can form a detection vector y (each point corresponding to a different time in the scan) that is analyzed to determine the mass spectrum, is described below.

II. Periodicity of Ion Trap Peak Shapes

As described above, mass analysis in a quadrupole ion trap (QIT) is typically performed by the technique of resonance ejection, where ions in the QIT are trapped and oscillate with characteristic frequencies, f(m, V), which depend on the mass m and the trapping amplitude V. During analysis, the trapping amplitude V is ramped to vary these frequencies, such that ions are brought into resonance sequentially in order of mass with a periodic excitation signal and ejected from the trap to an external detector.

A goal is to eject the ions with a high resolution of mass. Ideally, only one ion species is ejected at any one time. But, if ion species are close in mass, the ions may be ejected at least partially at overlapping times. For example, some ions are an entire Thompson (Th) apart. Such ions are relatively easy to identify. A Thompson is approximately the mass of one nucleon (either a single proton or neutron) per unit charge e. But, the average mass of a nucleon depends on the count of the nucleons in the atomic nucleus due to mass defect. Thus, different molecules can differ by fractions of a Th. It can be difficult to resolve ions with masses that are less than 1 Th apart, e.g., only 0.13 Th apart. Embodiments can provide such resolution.

A. Peaks are Composed of a Pattern of Discrete Ejection Events

Typically, the detector signal is sampled and filtered such that the peaks appear to have a Gaussian shape. In reality, the peaks are made up of discrete, periodic ejection events, referred to as "micropackets" (Remes IJMS 377 (2015): 368-384 2014). A simple analysis of the QIT as a driven harmonic oscillator might conclude that these micropacket events could occur twice per excitation period $p_\omega$ (once in each direction if two detectors are present), e.g., ejected just at the top and bottom of amplitude. However, ejection is also limited by the trapping RF and is primarily only possible once per trapping period $p_\Omega$ (which is more than once per excitation period). The result is that the interaction between the excitation and trapping fields makes a fairly complex pattern of micropackets possible.

For example, the ions of a particular mass form a cloud of ions having distribution of values, e.g., positions, velocities, and thus the ions do not all experience the same forces, otherwise, they would all be ejected in a single micropacket. Consequently, a small sub-population of the ion cloud, which is at the high end of the velocity or positional distribution, can first escape the trapping field, and then later the larger sub-population in the middle of the distribution will be ejected, resulting in a larger height for these later micropackets. The low end of the velocity or positional distribution is ejected last and would have a lower intensity. Given the periodicity in the ion trajectories, the distributions of values for ions being ejected at the excitation frequency would have similarities. However, true similarity is only true if the exact same phase relationship exists between the trapping signal and the excitation signal when ions of a particular mass reach the secular frequency that equals the excitation frequency. Only then will the ejection patterns may be identical for different masses. This phase relationship corresponds to where in their respective oscillation cycles the two masses are. The effect with respect to phase relationships is described below.

Figure 3:
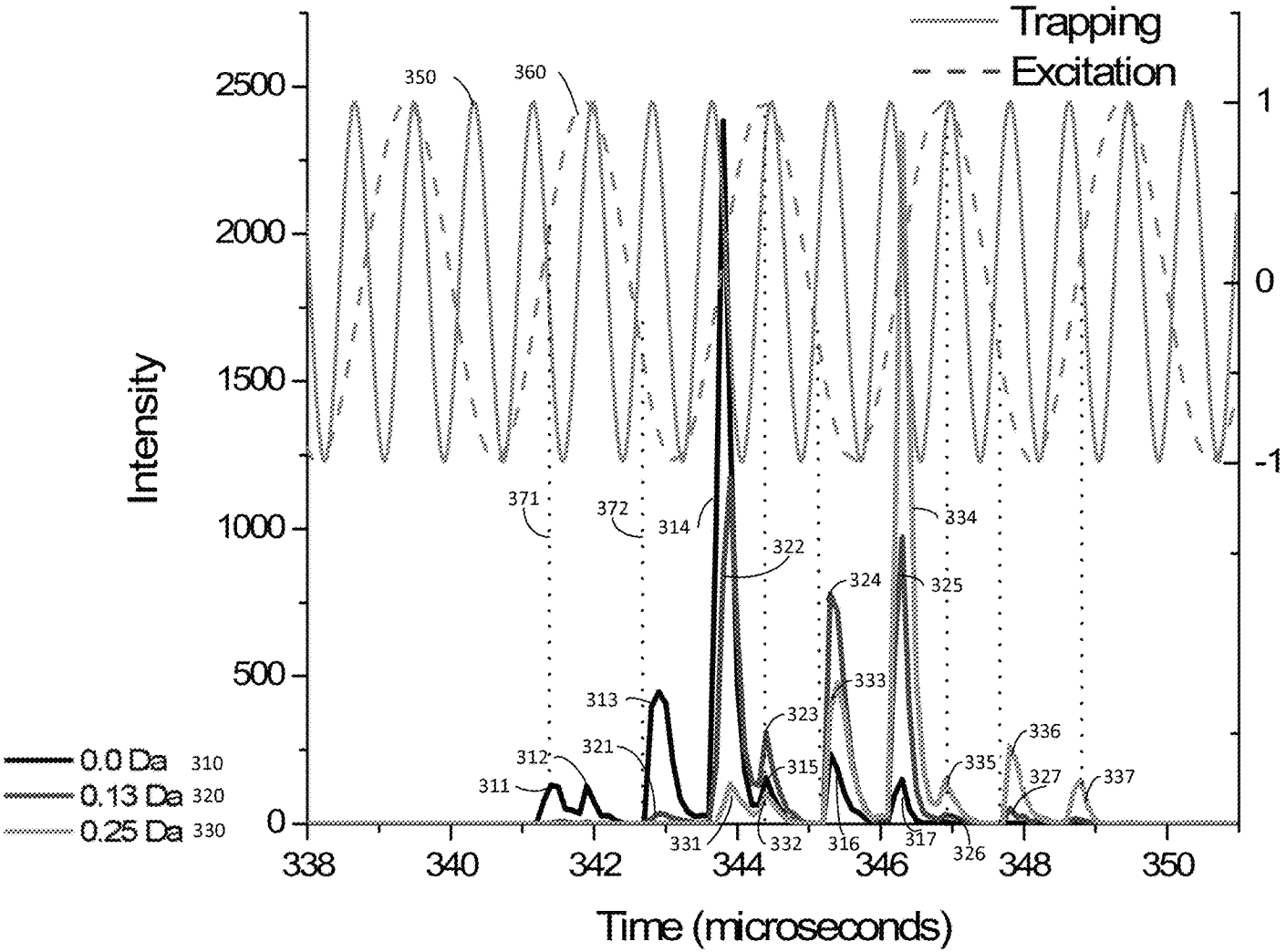
FIG. 3 shows simulated mass spectral peaks in a QIT at 100 kDa/s scan rate, with trapping frequency $\Omega$=1200 kHz and excitation frequency $\omega$=400 kHz for three successive masses shifted by 0.0 Th, 0.13 Th, and 0.25 Th from m/z 524.0 Th according to embodiments of the present invention.

FIG. 3 shows simulated mass spectral peaks in a QIT with trapping frequency $\Omega$=1200 kHz and excitation frequency $\omega$=400 kHz for three successive masses shifted by 0.0 Th, 0.13 Th, and 0.25 Th from m/z 524.0 Th according to embodiments of the present invention. Three simulated mass spectral signals due to ions of mass {m+0.0 Th, m+0.13 Th, m+0.25 Th} are shown in FIG. 3 for ejection at an excitation frequency which is ⅓ the trapping frequency ($\beta$=⅔) The simulation is performed using a computer program that traces the ion motion and can be used to simulate aspects of ion trap operation. For a given set of electrodes, position dependent voltages are stored in arrays, and the time dependent forces on the ions due to these potentials are integrated to update the ion velocity and position for a series of time steps (Remes IJMS 377 (2015): 368-384 2014).

Scaled representations of a trapping signal 350 and an excitation signal 360 are plotted in FIG. 3 over a range of about 14 microseconds. Both voltages are scaled to be within −1 to 1 (as shown on the right vertical axis), for ease of illustration. In actuality, the trapping voltage is in much larger than the excitation voltage. The left vertical axis shows the peak intensities for the spectral signals. Trapping signal 350 has a trapping frequency that is three times higher than the excitation frequency. Thus, the phase relationship between trapping signal 350 and excitation signal 360 repeats for every cycle of excitation signal 360. In this example, a common period of the trapping signal and the excitation signal is the excitation period, since the signals coincide every excitation period.

As shown in FIG. 3, the ions are ejected only at certain times, and are not ejected all at once. As discussed above, the ions of the same mass do not come out continuously over a smooth peak, but instead come out in a plurality of micropackets that together comprise a single peak corresponding to the particular mass. Each micropacket is detected as a subpeak. The certain times are specified by the relationship of the phases between the two signals.

Micropacket patterns are shown for the three masses, with micropacket pattern 310 corresponding to m/z 524.0 Th, micropacket pattern 320 corresponding to m/z 524.13 Th, and micropacket pattern 330 corresponding to m/z 524.25 Th. Each micropacket pattern includes seven subpeaks, with the overall pattern for a particular mass corresponding to a peak. Micropacket pattern 310 includes subpeaks 311-317. Micropacket pattern 320 includes subpeaks 321-327. Micropacket pattern 330 includes subpeaks 331-337.

As one can see, a first subpeak 311 of micropacket pattern 310 occurs at one phase relationship (identified by a dotted line 371) between trapping signal 350 and excitation signal 360. And, first subpeak 321 of micropacket pattern 320 occurs at a different phase relationship (identified by a dotted line 372) between the signals. While, first subpeak 331 of micropacket pattern 330 occurs at a same phase relationship as first subpeak 311.

Further, as one can see, the subpeaks generally appear at the same locations, if the subpeak is present. The subpeaks generally coincide with a certain phase of the trapping signal, e.g., when the two signals have a particular phase shift (e.g., with 30 or 90 degree phase shifts). Micropacket pattern 310 is different from micropacket pattern 320, although the peaks generally align if they exist. For example, subpeak 313 of pattern 310 generally occurs at the same time as subpeak 321 of pattern 320.

But, one can see that the pattern of the heights of the subpeaks does vary between pattern 310 and pattern 320.

For example, pattern 310 has subpeak 314 (the fourth peak) to be the largest, and pattern 320 has subpeak 322 (the second peak) to be the largest.

However, pattern 310 and pattern 330 are essentially equivalent, but with a shift of three cycles of the trapping voltage, which corresponds to about 2.5 microseconds. For example, subpeak 334 is the fourth peak and the largest, and subpeak 334 also occurs at a point where a rising edge of excitation signal 360 intersects with a falling edge of trapping signal 350, just as in subpeak 314. Further, first subpeak 311 and a second subpeak 312 of pattern 310 have about the same height and separation as a first subpeak 331 and a second subpeak 332 of pattern 330.

Thus, careful scrutiny reveals that under these conditions the relative ejection phases repeat with a period of 2.5 μs (the excitation period), and that the micropacket patterns from masses m+0.0 Th and m+0.25 Th are identical except for a shift in time (i.e., a shift of 2.5 μs), while the peak for m+0.13 Th is distinct. The mass m+0.13 Th coincides with a different set of relative waveform phases for the subpeaks of micropacket pattern 320, resulting in different relative micropacket intensities. Whereas, the patterns of subpeaks (e.g., the heights and relative distance between subpeaks) are the same for micropacket patterns 310 and 330. Thus, for the given settings of the trapping and excitation voltages, the patterns repeat about every 0.25 Th. For masses in between, the patterns would vary, e.g., the heights of the subpeaks would vary.

Accordingly, this phenomenon of periodic micropacket patterns is due to the discrete ion ejection events, which in turn depend on the phase relationships of the trapping and excitation signals. As part of an ejection, the amplitude of the trapping signal is changed, and the ion frequencies of the ions change in the same direction as the amplitude (e.g., the frequencies would increase with increasing amplitude of the trapping signal). In FIG. 3, the trapping signal is normalized and shown with a constant amplitude, since over such a short time scale, the relative change in amplitude is not great. None-the-less, at a later time, the amplitude of the trapping voltage will have a changed as V is scanned.

If the secular frequency of ions of two different masses reach the excitation frequency at the same phase relationship between the two signals during mass analysis, then the detected pattern will be the same. This expected pattern can be used to resolve a particular mass from ions of very similar masses. The same phase relationship can be achieved in a variety of ways, and thus be reproducible. For example, the scan (ramp) rate can be the same from one analysis to another. Thus, if a scan starts at a same phase shift between the signals, then the same phase relationship can be achieved from one scan to another when the scans start at a same trapping amplitude. Or, if the phase relationship is simply identified, then the pattern can be offset accordingly by techniques described in more detail below.

B. Patterns of Ejections being Delays on One Another

As described above, the micropacket pattern (peak shape) for a given mass is dependent on the phase relationship of the trapping signal and the excitation signal. As a further demonstration of the periodicity of the ion trap peak shapes as a function of a common phase, a comparison was performed between experimental and simulated ion trap peaks at frequency where the excitation frequency is ⅖ the trapping frequency ($\beta=4/5$) for different waveform delays $\phi(t)$. The term $\beta$ refers to the relationship between the trapping frequency $\Omega$ and the secular frequency $\omega$ of the ion, as defined by excitation frequency=$\beta$*Trapping frequency/2. Ions having $\beta<1$ are theoretically stable, and ions with $\beta>1$ are unstable.

Figure 4A:
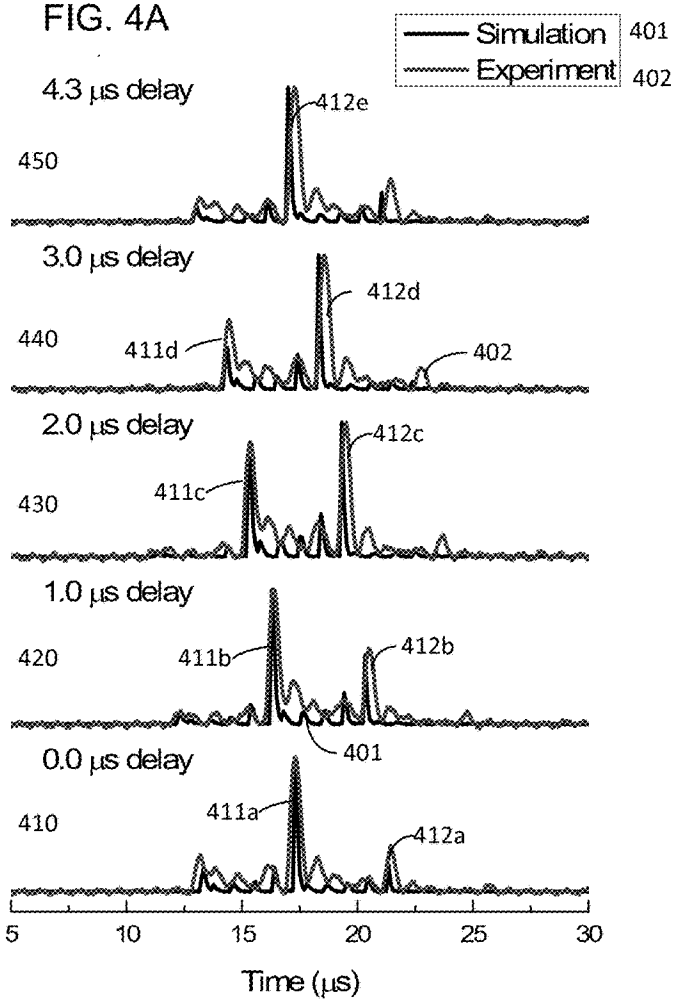
FIG. 4A shows a comparison of simulated peaks to experimental peaks using a high bandwidth at different common waveform delay times according to embodiments of the present invention.

FIG. 4A shows a comparison of simulated peaks to experimental peaks using high bandwidth and at different delay times according to embodiments of the present invention. Plots 410-450 show a simulated pattern 401 and an experimental pattern 402. These patterns all correspond to ions of the same m/z. Each plot corresponds to a different time offset (delay), and therefore different phase relationship between the trapping and excitation voltages when ions of the same mass reach the excitation frequency. Thus, under normal scanning conditions each pattern would correspond to a different mass for a single mass analysis (e.g., a higher mass would reach the excitation frequency at slightly later times).

First, although there are slight shifts between the locations of the various micropacket positions in simulation versus experiment, the patterns are generally quite similar. For example, the location of the highest peaks generally align between simulation versus experiment. Further, the numbers of large and small peaks are similar. Thus, the simulated data is sufficiently close to the physical data that periodicity of the micropacket patterns is accurate.

Secondly, the periodicity in the micropacket pattern can be seen to be about 4.3 μs. The shifting patterns and periodicity is illustrated as follows. A subpeak 411*a* in plot 410 can be seen to move to the left in successive plots 420-440, illustrated as subpeaks 411*b*-411*d*, which get progressively smaller. Further, a peak 412*a* also moves to the left in successive plots 420-450, illustrated as subpeaks 412*b*-412*e*, which get progressively larger. Then, for plots 410 and 450, the largest peak 411*a* in plot 410 is at essentially the same time location as the largest peak 412*e* in plot 450, which shows the periodicity to be about 4.3 μs. Thus, each time offset (delay) corresponds to a different phase in the common period (i.e., 4.3 μs).

Figure 4B:
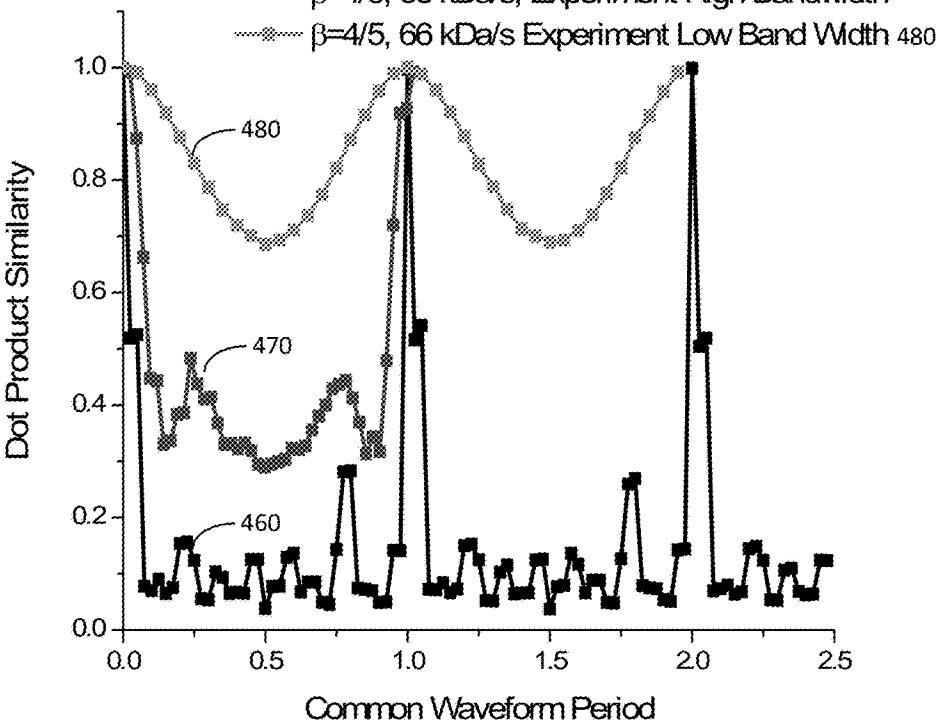
FIG. 4B shows a dot product similarity of a first micropacket pattern to other micropacket patterns as a function of the common waveform period according to embodiments of the present invention.

To further demonstrate the periodicity, FIG. 4B shows a dot product similarity of a first micropacket pattern to other micropacket patterns as a function of common waveform period according to embodiments of the present invention. To evaluate the similarity of one micropacket pattern for one delay time in the common period to other micropacket patterns, each micropacket pattern was compared to the micropacket pattern at delay time t=0, using the cosine similarity measure, $$\frac{x_{\phi(0)}x_{\phi(t)}}{\|x_{\phi(0)}\|\|x_{\phi(t)}\|},$$

where $x_{\phi(t)}$ is the micropacket pattern acquired at delay time t. Accordingly, all the patterns came from a peak ejected at the exact same time but corresponded to different delay times so that the trapping signal and the excitation signal have a different phase relationship at the ejection time.

The horizontal axis corresponds to a different delay time within the common period. As explained above, each delay time results in a different micropacket pattern. The vertical axis shows how similar the corresponding micropacket pattern is with the micropacket pattern at time t=0. The dot product similarity is performed over an equivalent time interval, i.e., based on when the ions of the corresponding mass begin to be ejected. A perfect match results in a dot product similarity of 1.0. As would be expected, the similarity at t=0 is 1.0, as the dot product is of the first micropacket pattern with itself.

The results show a clear periodicity corresponding to the common period. The micropacket pattern at a full common period is shown to be equal to the micropacket pattern at t=0, as the dot product similarity is 1.0 at the full common period. The bandwidth of the acquisition (i.e., the data acquisition rate) plays a role in the similarity between micropacket patterns. The low bandwidth acquisition 470 was on the order of 400 kHz, and the high bandwidth acquisition 480 was on the order of 2-4 MHz. The change in dot product similarity is more reproducible for the low bandwidth acquisition 480, and shows a sinusoidal pattern, which repeats through one and two common periods. Thus, the micropacket pattern at 0.5 of the common period is equivalent to the micropacket pattern at 1.5 of the common period. The micropacket patterns within the common period (i.e. 0 to 1.0) can be used to forma subset of basis functions, where the entire subset can be shifted to generate the micropacket patterns for between 1.0 and 2.0 of the common period, and further.

C. Lowest Common Period

The repeating pattern only happens when the frequencies of the trapping and excitation signals are fractions of each other since the trapping and excitation signals may not repeat the same pair of respective phase values for a long time. The time that it takes to achieve the same pair of respective phase values is the lowest common period, as is discussed below. The common period is $p_c$. The trapping period is $p_\Omega$ for the trapping signal of frequency Ω. The excitation period is $p_\omega$ for the trapping signal of frequency ω.

The pattern of micropacket relative intensities can be made to be periodic with a period $p_c$, which is related to the periods $p_\Omega$ and $p_\omega$ via their lowest common multiple. For example, if $$\frac{p_\omega}{p_\Omega} = \frac{a}{b};$$

a, b $\in \mathbb{N}_{>0}$, the lowest common period is $p_c = ap_\Omega$. In the simulation depicted by FIG. 3 where the waveform periods are $p_\Omega = 0.83\overline{3}$ μs and $p_\omega = 2.5$ μs, the relation is $$\frac{p_\omega}{p_\Omega} = \frac{3}{1},$$

and thus $p_c = 3p_\Omega = 2.5$ μs. Another example parameter setting is $$\frac{p_\omega}{p_\Omega} = \frac{5}{2},$$

for which $p_c = 5p_\Omega$.

Figure 5:
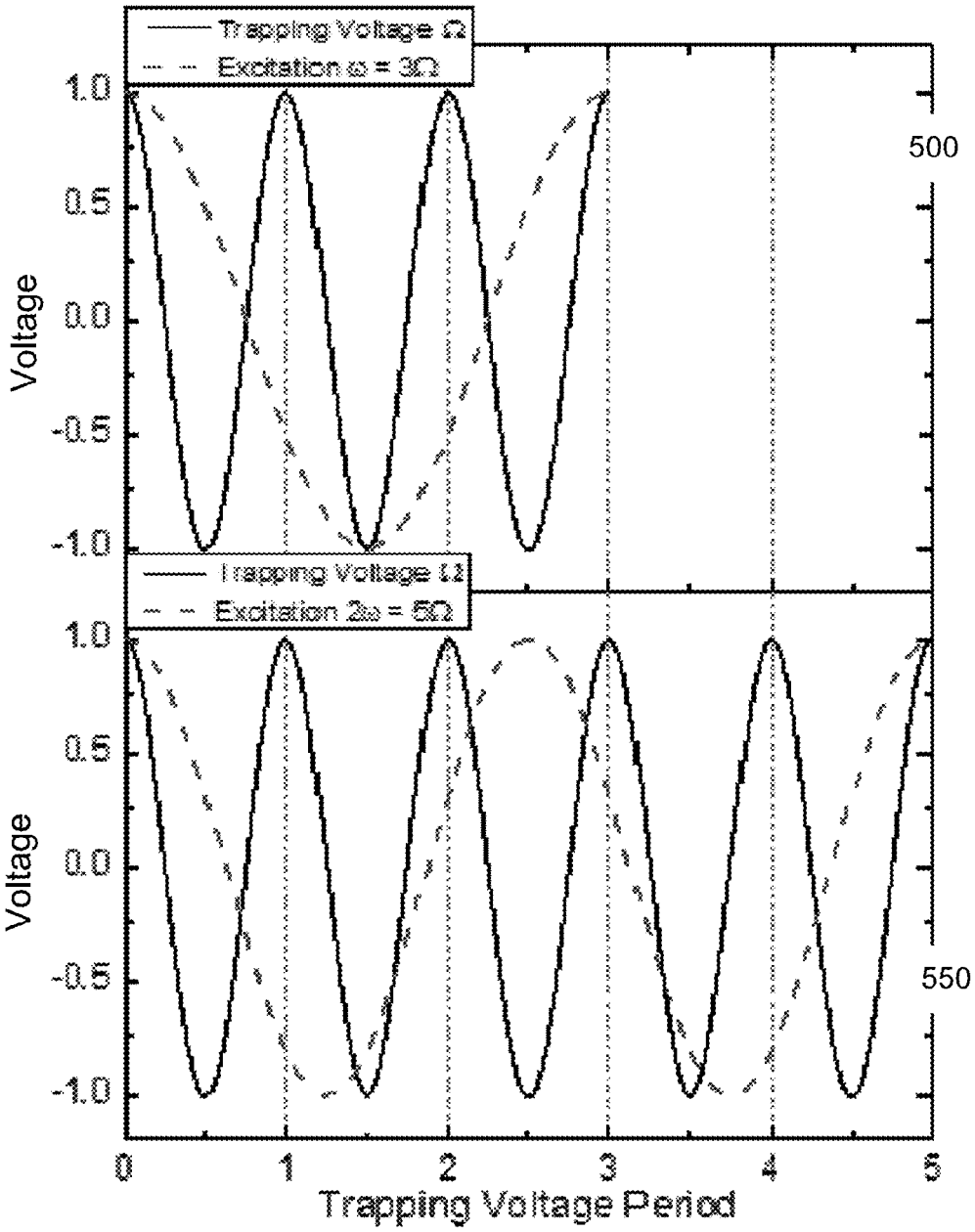
FIG. 5 shows trapping and excitation signals (waveforms) with different relative frequencies according to embodiments of the present invention.

FIG. 5 shows plots 500 and 550 of trapping and excitation signals (waveforms) with different relative frequencies according to embodiments of the present invention. The horizontal axis is in units of the trapping period, and the vertical axes correspond to the voltages of the signals. The amplitude of the trapping signal may not be the same as the amplitude for the excitation signal, but the amplitudes are shown equal for ease of illustration.

Plot 500 shows the trapping frequency to be three times larger than the excitation frequency, and thus the excitation period $p_\omega$ is three times larger than the trapping period $p_\Omega$. With both signals starting at the highest value (e.g., zero phase for cosine), the signals coincide to both be at the highest value after three trapping periods. Thus, the common period is three trapping periods, which also equals one excitation period.

Plot 550 shows the trapping frequency to be 5/2 times larger than the excitation frequency, and thus the excitation period $p_\omega$ is 5/2 times larger than the trapping period $p_\Omega$. With both signals starting at the highest value (e.g., zero phase for cosine), the signals coincide to both be at the highest value after five trapping periods, as that is the amount of time for the two signals to have their phase relationship repeat (i.e., both phases are back to zero in this example). Thus, the common period is five trapping periods. For the situation where $p_\Omega$ and $p_\omega$ are not related via a whole number fraction and thus have no common period in the time scale we are interested in, the mass spectral peaks have non-repeating micropacket patterns. Therefore, no peak is exactly related to another peak via a simple time shift, and optimal peak detection is not possible.

The initial phases of both signals do not have to be the same (e.g., zero for cosine); any pair of initial phases can exist to define the phase shift between the trapping signal and excitation signal. The phase shift corresponds to the phase difference determined at a particular point in time, e.g., when the excitation signal is at a maximum. The phase shift may be determined according to U.S. Pat. No. 7,804,065. To have a same mass experience a same phase relationship, the phase shift should be the same from one scan to another, or at least be a multiple of $$2\pi\frac{p_\Omega}{p_\omega}.$$

Let us define the sinusoid $$f(t) = \cos\left(\frac{2\pi}{p_c}(t - t_0) + \phi_0\right)$$

with argument $$\frac{2\pi}{p_c}(t - t_0) + \phi_0 = \phi(t)$$

as the common waveform and its phase (called "common phase"), with arbitrary common phase offset $\phi_0$, respectively. The common phase offset $\phi_0$ corresponds to the phase at time $t = t_0$. This common waveform relates to how the phase relationship of the trapping signal and the excitation signal change over time. Given the common period $p_c$, the phase relationship repeats every time length of $p_c$. The common phase offset $\phi_0$ can be any value. To have a same mass experience a same phase relationship, the common phase should be the same from one scan to another, or at least a multiple of 2π.

The selection of the trapping frequency and the excitation frequency can also affect the total mass range covered in a scan as well as other performance characteristics. The trapping frequency provides a range of masses that can be trapped, with a lower trapping frequency allowing ions of higher mass to be trapped, and thus a larger mass range that is trapped, but lowers the ion capacity and degrades resolution. The excitation frequency specifies a highest mass that can be analyzed, for a given trapping frequency and voltage. For example, if a mass is so large that its secular frequency cannot reach the excitation frequency with a given maximum trapping voltage, then that mass is not able to be ejected and is not analyzed. One can lower the excitation frequency to increase the maximum mass, but a lower excitation frequency also raises the minimum mass that can be detected (e.g., if the secular frequency is already higher than the excitation frequency at the beginning of the scan) and also can lower the mass resolution. Thus, higher frequencies and a higher ratio of frequencies is desirable.

III. Mass Functions

As described above, two sets of ions at two different, known masses are ejected at different times. If the two masses are ejected at a time difference that is equal to a common period of the trapping signal and excitation signal, then the micropacket patterns will be the same. The patterns will occur at different times in the scan, but the overall pattern will essentially be identical.

As one knows the scan rate and initial conditions, each of the two micropacket patterns can be identified as corresponding to a particular mass. These shifted, but otherwise identical, micropacket patterns are two examples of mass functions. Other micropacket patterns would correspond to different mass functions for different masses. A mass function can be stored as a set of intensity values determined (e.g., measured) at a particular data acquisition rate. A set of mass functions can correspond to the range of masses that are scanned, and the mass functions can be used to resolve the detected data.

If the two masses are ejected at a time difference that is less than a common period, the two micropacket patterns will differ by more than by a simple shift. These two micropacket patterns can be considered basis functions as they are less that one common period apart from each other. The term "basis function" also indicates that these micropacket patterns can be used to generate mass functions for masses that are more than a common period away in the time of ejection.

A. Determining Basis Functions

An objective is to provide a basis set of what individual peaks actually look like, where the basis set can be used to generate mass functions for the scan range to within a desired resolution. Embodiments can use the substructures (i.e., micropacket patterns) of the peaks as the basis set, as is discussed above. As each of the micropacket patterns are different for masses scanned within a common period of the trapping signal and the excitation signal, and then the micropacket patterns repeat, the micropacket patterns for masses scanned within the common period form a basis set of basis functions.

Micropacket patterns for a single mass acquired at different initial phases $\phi_0$ that span a common period can be determined, and used as the basis set. The different initial phases would correspond to different masses. Theoretically, different masses could be used, but such an implementation would be difficult in practice, e.g., to obtain calibration samples with the specific masses.

The common period can be selected from any of the common period that occur during a scan, e.g., the first common period (e.g., 0-$p_c$), the last common period, or any common period in between. As the basis functions (micropacket patterns) span a subrange of masses scanned within a common period, the detected data can be compared to the basis set to determine which masses were present in the detected ions. As is explained in more detail below, even if there are multiple peaks that overlap during a common period, a deconvolution can identify the contribution of each mass based on the individual micropacket patterns of the ejection events.

To determine the micropacket patterns within the common period, one can use analytical equations. But, such analytical equations can be difficult when different devices have slight variation. The slight variations in the devices can cause slightly different micropacket patterns. In such situations, a calibration procedure can be performed for each device to determine basis functions for that device. Thus, the basis functions can depend on a specific device, i.e., each device can have a slightly different set of basis functions relative to another device.

Figure 6:
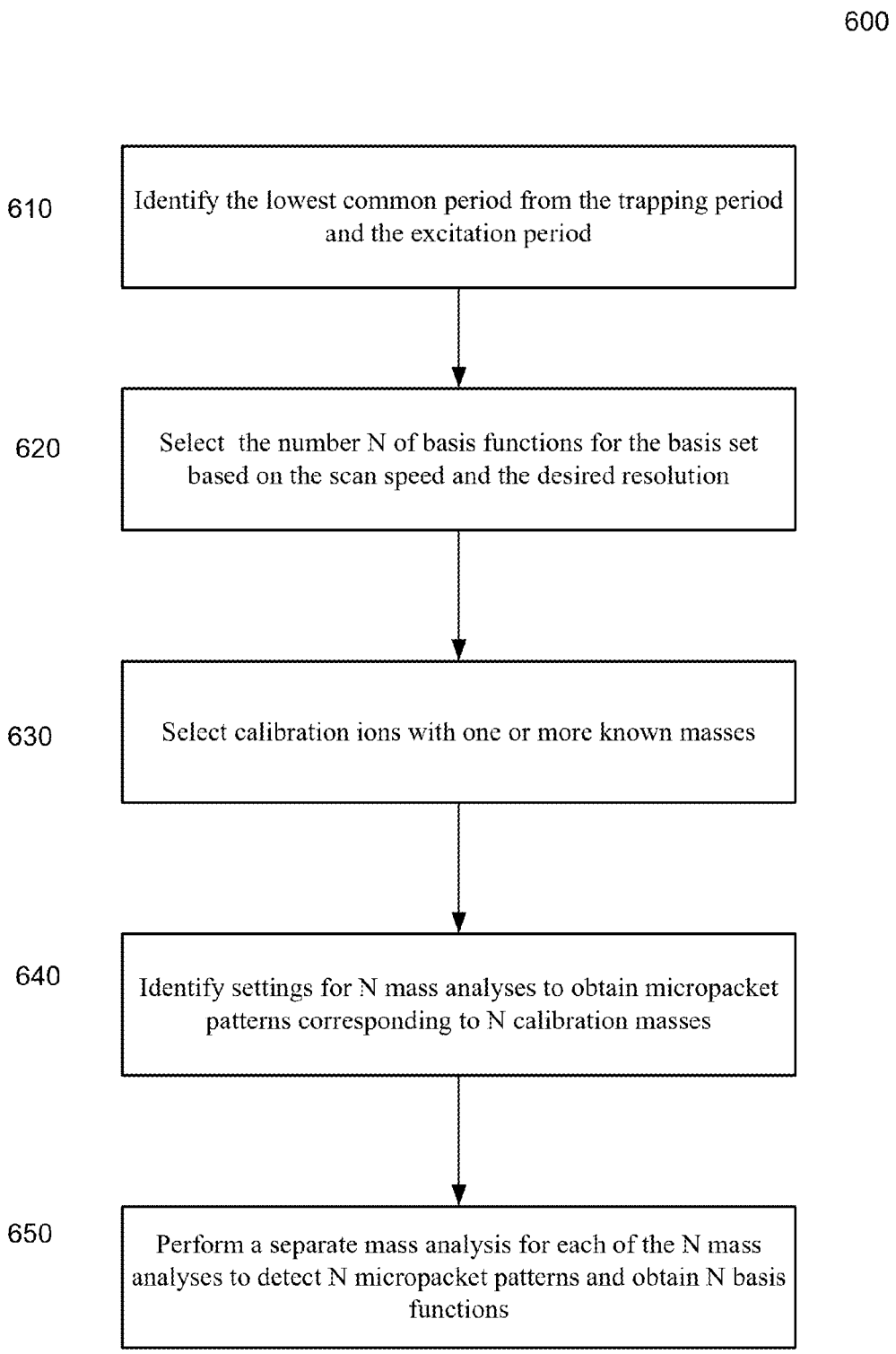
FIG. 6 is a flowchart illustrating a method 600 of creating an initial subset of N basis functions according to embodiments of the present invention.

FIG. 6 is a flowchart illustrating a method 600 of creating an initial subset of N basis functions according to embodiments of the present invention. Method 600 can use ion of one or more known masses to determine the basis functions with the common period. The initial subset of N basis functions can be used as a basis set for generating mass functions. Method 600 can be performed at last partially using a computer system, as can other methods described herein.

At block 610, the lowest common period is identified from the trapping period and the excitation period. The basis functions depend on the integer ratio of the trapping period and the excitation period that specifies the lowest common period, as described above, e.g., for FIG. 5. There would be different basis sets for different settings of the trapping period and the excitation period. Thus, a same setting of the trapping period and the excitation period used to determine the basis set would need to be used when performing a mass analysis using the basis set. If other settings are used, then another basis set can be determined.

Higher integer ratios of the excitation period to the trapping period can provide more subpeaks in a micropacket pattern. Having more subpeaks can potentially provide better resolution in differentiating one basis function from another. Higher ratios also correspond to higher excitation frequencies with higher frequency dispersion per mass unit, which gives better mass resolution. However, at the highest possible ratio of ½, the spectral space charge capacity is diminished and mass resolution can suffer, since this condition also corresponds to the stability boundary, i.e. quadrupolar field resonance. The most useful ratios are therefore those with high space charge capacity, high frequency dispersion per mass unit, and short common period, i.e. ¼, ⅓ and ⅖.

At block 620, the number N of basis functions for the basis set is selected based on the scan speed and the desired resolution. For a given common period, the scan speed will affect the mass range covered in a time interval of the common period. A smaller mass range covered by the scan during a common period can result in fewer basis functions being needed. However, a slower scan rate does require basis functions that span a longer time. The total number of mass functions can be determined based on the desired resolution and mass range, regardless of the scan rate In some embodiments, a slower scan speed would result in a smaller mass range within the time interval of the common period. Accordingly, for a desired resolution (e.g., 0.05 Th), less basis functions may be used. For example, if the mass range covered 1.0 Th for a fast scan, then 20 basis functions may be needed to achieve a 0.05 Th resolution.

Whereas, a slow scan might cover 0.5 Th in a common period, and thus only 10 basis functions may be needed.

However, in some implementations, having fewer basis functions can cause problems. For example, in the limit of the desired resolution being equal to scan rate for one common period, there would only be one basis function in the basis set. In such a situation, the desired resolution may not be achievable since all of the mass functions will have the same pattern, just shifted by the common period. More importantly, such a slow scan might take too long to be practical. One of the limitations on scan speed is the number of micropackets in a peak. In the limit of fast scanning, all ions are ejected in just one micropacket, and thus there would be only one basis function in the basis set. A more practical upper limit on the scan rate is about two common periods per mass unit, which is enough to observe around 3-5 micropackets (FIG. 3), so as to provide acceptable mass resolution.

As to the values of N and the desired resolution, assume the common period is 2.5 usec. As in FIG. 4B, an embodiment might use on the order of 50 basis functions, which is 0.05 microsecond between each basis function. At a scan rate of 66 kDa/s (15 usec/Th), this is 0.003 Th resolution. Depending on scan rate, the basis set would on the order of 10-100 basis functions.

At block 630, calibration ions with one or more known masses are selected. The masses may be known with high precision. In some embodiments, the number of known masses can be equal to one, M, or any number in between. Each of the M calibration ions can be used to generate a set of N basis functions that span a common period. In the case where there are subtle differences in the bases as a function of mass, then the basis set for each calibration ion is used to characterize ion ejection for analyte ions in the neighborhood of the calibration ion m/z. As an example of M=2, a calibration ion with a small mass can be used to generate a basis set to be used for a lower portion (i.e., smaller masses) of the scan range, and another calibration ion with a larger mass can be used to generate a basis set to be used for a higher portion (i.e., higher masses) of the scan range At block 640, settings for N mass analyses per M calibration ion are identified to obtain micropacket patterns corresponding to M basis sets. Each setting corresponds to a different micropacket pattern, which in turn corresponds to a different mass. Each of the settings has a same scan rate, a same trapping frequency, and a same excitation frequency, and a same shift between trapping and excitation waveform. The same phase shift can be achieved by phase locking the signals according to techniques known by one skilled in the art.

Each of the N settings can effectively provide a micropacket pattern corresponding to a different mass, even though ions of a same mass are used. For example, assume that the phase shift is zero, which corresponds to the examples in FIG. 5. And, assume that ions of the single known mass begin ejection at time 0 in the common period for a $1^{st}$ setting. Then, if a $2^{nd}$ setting for a next mass analysis has the scan delayed by a time offset, then ions will begin ejection at a different phase relationship. The time offset would correspond to when a second mass would begin ejection, if the scan had started at the same time as the $1^{st}$ setting. The second mass can be determined based on the scan rate. Accordingly, different basis functions can be determined using ions of a same mass. A same result can be achieved by starting the scan at a different initial trapping amplitude, which equates to a time offset defined by the scan rate.

At block 650, a separate mass analysis is performed for each of the N mass analyses to detect N micropacket patterns and obtain N basis functions. As described above, each mass analysis provides a micropacket pattern for a different mass. These N basis functions can then be used to determine mass functions for other masses that would be ejected at other times.

Accordingly, each basis function of a subset of N basis functions can correspond to a different time offset within the common period. In one embodiment, for each Ith time offset of N time offsets comprising the common period, calibration ions having a calibration mass-to-charge ratio are trapped in the trap volume. The value of I would correspond to current iteration of changing the time offsets, which may be done incrementally, with each Ith time offset being larger by a same amount than the previous time offset, i.e. (I−1)th time offset. The excitation electric field is generated to be superimposed on the trapping electric field. The trapping amplitude is changed at the ramp rate to eject the calibration ions at the Ith time offset. As mentioned above, the Ith time offset can be selected by delaying when a scan starts and/or a starting trapping amplitude. The calibration ions that are ejected from the trap volume are detected to generate an Ith basis function of the initial subset of N basis functions.

In FIG. 4A, each of the plots 410-440 would correspond to a different basis function. Or, in FIG. 4B, each of the 20 dot similarity values are determined for each of 20 different basis functions. As the $21^{st}$ value is the same as the $1^{st}$ value, the $21^{st}$ is part of a different subset of basis functions, which is simply the first subset shifted by a common period.

The determination of the basis set can be performed periodically, e.g., as a calibration process of a device. Multiple basis sets can be determined, depending on how many different settings might be used for the trapping frequency and the excitation frequency, or depending on if subtle differences exist between bases generated for calibrant ions of different m/z. The various basis sets can be determined and then stored for later use when a set of mass functions needs to be generated for a particular scan.

Further, a micropacket pattern can be longer than the common period (e.g., as shown in FIG. 3), even though the basis functions only span one common period (i.e., the basis function repeat every common period). For instance, where the scan rate is very slow, for example 1 kDa/s (1000 usec/Th), the actual peak widths are on the order of 200 microseconds, which is much longer than a common period of 2.5 microseconds.

B. Determining Mass Functions from Basis Functions

Once the basis set has been determined for the common period, these can then be used to determine mass functions used for the entire mass range that is to be scanned. The determination of a set of mass functions can be performed when a mass analysis scan is defined. For example, the mass functions are dependent on a particular starting and ending mass-to-charge ratio specified. Based on the specified range, the mass functions can be generated from the corresponding basis set which must also correspond to the same trapping frequency and excitation frequency being utilized in the scan.

Figure 7:
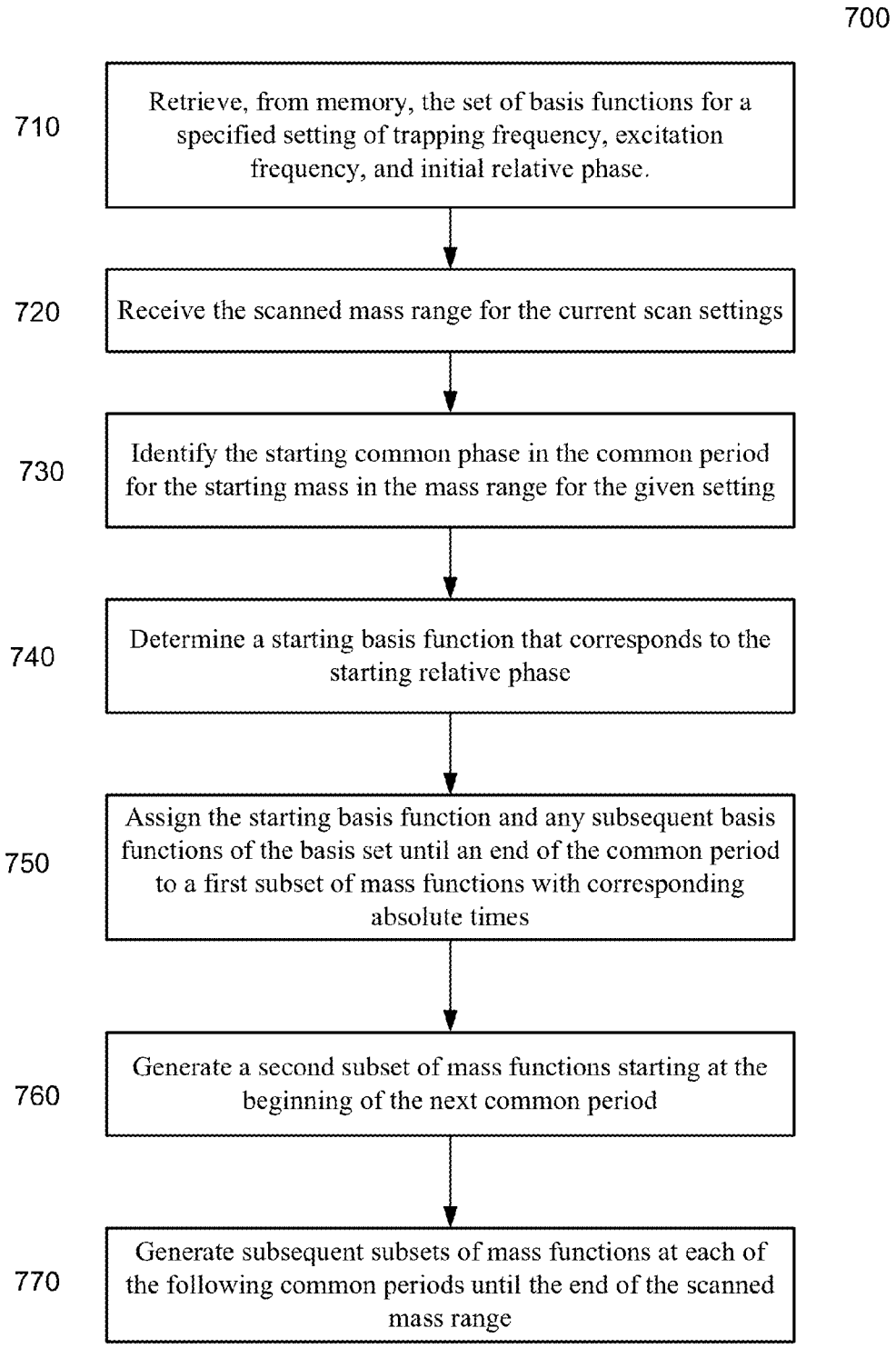
FIG. 7 is a flowchart illustrating a method 700 for generating a set of mass functions for a specified mass range according to embodiments of the present invention.

FIG. 7 is a flowchart illustrating a method 700 for generating a set of mass functions for a specified scanned mass range according to embodiments of the present invention. The set of mass functions can be used in determining a mass spectrum of a sample using data detected during a scanning procedure. Method 700 determines which basis functions correspond to which absolute times in the scan. The basis function at a particular absolute time is assigned a mass based on the scan settings (e.g., scan rate and starting trapping amplitude), thereby defining a mass function to be the basis function at the particular absolute time that corresponds to the particular mass.

At block 710, the basis set of basis functions for a specified setting of trapping frequency, excitation frequency, and phase shift is retrieved from memory. The basis set can be identified in various ways. For example, the ion trap device may be configured to only work with specific values for the above variables, and thus there may be just one basis set in memory. In other implementations, the values of a setting can be specified (e.g., by a user), and the memory can be searched for a basis set that is stored with the same settings. Thus, the memory can store multiple basis sets, each stored in association with the setting used to generate the basis set. For instance, the basis sets may be stored in a table, with fields corresponding to the above variables.

At block 720, the scanned mass range for the current scan setting is received. For example, a starting mass and an ending mass can be specified. A user can specify such a mass range in a variety of ways, such as via a controller of the spectrometer (e.g., controller 31 of FIG. 1) or another computer that is connected to the spectrometer. In one implementation, a starting mass (e.g., 100 Th) a value of the total mass range (e.g., 1900 Th) are specified, where the ending mass is thus specified as 2000 Th. The reverse can also be done by specifying the ending mass and a total mass range.

At block 730, the starting common phase in the common period for the starting mass in the mass range is identified for the given setting. The phase shift between waveforms can correspond to the phase shift between the trapping signal and the excitation signal at their maximum voltages. This phase shift is a property of the two signals, and does not change from one scan to another, at least for scans using the specified basis set. But, the starting common phase can vary based on when the scan starts. For example, in FIG. 5, a scan could start at 0 in the trapping period, but a scan could also start at 0.5 of the trapping period. Each of these starting common phases would correspond to a different basis function.

At block 740, a starting basis function that corresponds to the starting common phase is determined. The basis functions of the basis set are effectively defined for different common phases of the common period. Thus, the starting common phase can exactly correspond to one of the basis functions. In this case, the selected basis function would correspond to an absolute time in the scan of zero, and the mass of the basis function would equal the mass corresponding to the trapping amplitude at that time.

But, it is not necessary for the starting common phase to be exactly the same as one of the common phases of the basis functions. For example, a basis function of a next common phase can be identified. This basis function can be assigned to an absolute time that is not zero, but is related to the difference between the starting common phase and the common phase of the next basis function. For instance, if the difference is 0.01 of the common period (e.g., 2.0 μs), then the absolute time would be 0.02 μs.

The next basis function will correspond to a mass that will be ejected at the corresponding absolute time. The mass can be determined based on the scan rate and the starting mass. This absolute time value can be considered a difference between a mass function and a basis function, as the basis functions are defined with respect to the common period, whereas the mass functions are defined with respect to an absolute time of the scan.

Accordingly, the starting basis function does not need to be the first basis function in the basis set, e.g., the basis function corresponding to the common phase of zero. For example, the starting common phase can be in the middle of a common period. Thus, the starting common phase may be anywhere in the common waveform.

At block 750, assign the starting basis function and any subsequent basis functions of the basis set until an end of the common period to a first subset of mass functions with corresponding absolute times. For example, the starting basis function can be the $10^{th}$ basis function out of 20 basis functions in the basis set. As explained above, the $10^{th}$ basis function is assigned to an absolute time of the scan (e.g., zero or some positive time based on the difference of the phase delay of the $10^{th}$ basis function and the starting common phase). Then, basis functions 12 to 20 can be assigned to absolute times, given their corresponding common phases and the common period. For example, if the $10^{th}$ basis function has an absolute time of zero and the common period is 2.0 μs, then the $11^{th}$ basis function is assigned to 0.1 μs, the $12^{th}$ basis function is assigned to 0.2 μs, and so on. Each of these times correspond to a different mass, which is dictated by the scan rate, which has units of mass (i.e., mass-to-charge ratio) per unit time.

At block 760, a second subset of mass functions starting at the beginning of the next common period is generated. This second subset of mass functions would correspond to all N basis functions of the basis set. Continuing the example from above, the $20^{th}$ basis function would be assigned an absolute time of 1.0 μs, and the second subset of mass functions would correspond to 1.1 μs to 2.1 μs in increments of 0.1 μs.

At block 770, subsequent subsets of mass functions are generated at each of the following common periods until the end of the scanned mass range. The subsequent subsets can be generated in a similar manner as the second subset. A last subset may also be a partial subset, e.g., in a similar way that the first subset may also be partial for not including all N basis functions, where N corresponds a number of basis functions within the common period.

In some embodiments, multiple basis sets can be used, each for different part of the total mass range. For instance, the micropacket patterns in a common period may differ for large differences in mass. One set of micropacket patterns might be used for low masses (e.g., 50 Th) and slightly different micropacket patterns might be detected for high masses (e.g., 2,000 Th). Thus, the basis functions for a common period may vary from low masses to high masses.

To address this problem, a first basis set can be generated using a calibration mass in a low mass subrange. And, a second basis set can be generated using a different calibration mass in a high mass subrange. Then, the first basis set can be used to generate the mass functions in the low mass subrange, and the second basis set can be used to generate the mass functions in the high mass subrange. Thus, a particular basis set can be applicable to many common periods within a single mass subrange, and then a higher mass subrange can use a different set of basis functions to generate the mass functions in the higher mass subrange.

In some embodiments, it is possible to vary the trapping frequency to eject ions. In such a case, the mass functions would not repeat every common period. The full set of mass functions can be generated individually, as opposed to creating a basis set and then using the basis set to determine the mass functions for the full mass range.

C. Resolution

The resolution for determining the mass spectrum is related to the rate that the trapping amplitude is scanned and to the number of basis functions in a basis set. In terms of the physics of ion trap mass analysis, higher resolution is achieved at slower scan rates, and the upper limit on scan rate is determined based on the time spacing between micropackets. In embodiments, the resolution has a dependence on the spacing of the basis functions. If the scan rate is lower, then fewer basis functions may be needed to obtain the desired resolution. But, if the scan rate is higher, then more basis functions would be needed. For both scenarios, the separation in mass of the basis functions can be the same, with the more basis functions needed when the scan is faster. In general, the number of basis functions cannot be increased to an arbitrarily large number to achieve arbitrarily high resolution, because adjacent basis functions will become more and more similar, particularly if the data acquisition rate was not increased and when the detector has a limited resolution.

With a slower scan, there can be more subpeaks, as a particular mass can be ejected over a longer period of time. Depending on settings, such subpeaks can be relatively quite small, and thus such subpeaks may not be helpful. But, if such additional subpeaks are of appreciable height, then such additional subpeaks can help in achieving greater resolution.

Resolution can also be affected by gases present in the ion trap, the pressure of such gases, and space charge effects dependent on the total amount of ions present in a single mass analysis. Thus best results will be achieved when the pressure and number of ions in the calibration procedure is about the same as the later analytical mass analyses.

IV. Determining the Spectrum Using Shifted Subsets of Basis Functions

Once a set of mass functions have been determined for the total range of masses being scanned, an experimental run for the ion trap can be performed. The resulting data can be analyzed using the set of mass functions.

A. Method

Figure 8:
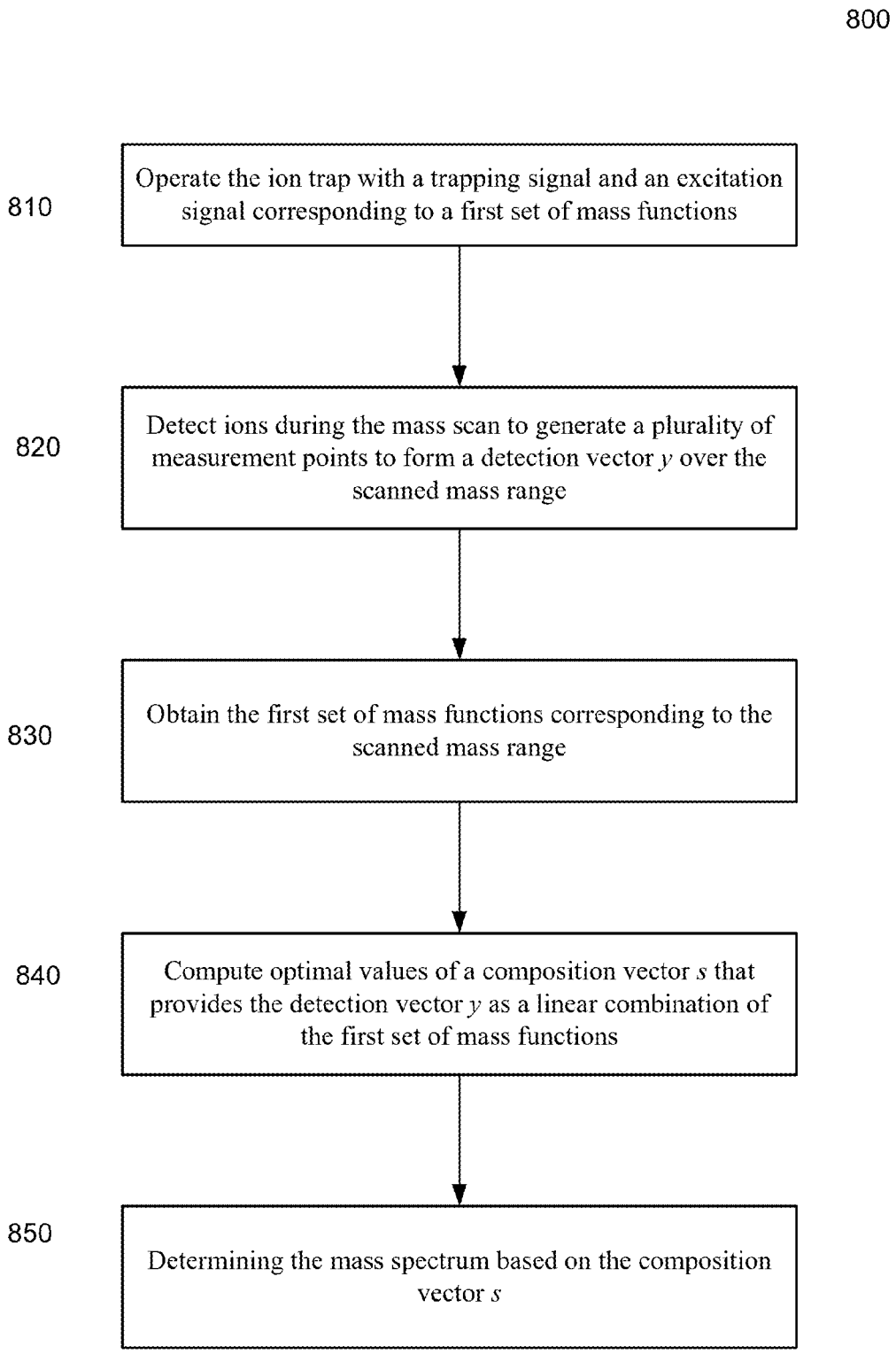
FIG. 8 is a flowchart illustrating a method 800 for determining a mass spectrum of a sample using an ion trap according to embodiments of the present invention.

FIG. 8 is a flowchart illustrating a method 800 for determining a mass spectrum of a sample using an ion trap according to embodiments of the present invention. The sample can be any sample from which ions may be generated. Method 800 can be performed using blocks from method 200.

At block 810, the ion trap is operated with a trapping signal and an excitation signal corresponding to a first set of mass functions. The trapping frequency and the excitation frequency have a prescribed relationship, as described herein, namely they are an integer ratio of each other. For example, K times a trapping period $P_\Omega$ of the trapping signal equals M times an excitation period $P_\omega$ of the excitation signal, where K and M are integers and where K is greater than M. Such a relationship is such that K times the trapping period $P_\Omega$ defines a common period of the trapping signal and the excitation signal. The values for K and M correspond to values used in generating the basis set used to generate the first set of mass functions.

At block 820, ions are detected during the mass scan to generate a plurality of measurement points to form a detection vector y over the scanned mass range. As in block 240 of FIG. 1, the trapping amplitude is changed at a ramp rate to sequentially eject sets of ions from a trap volume. The plurality of measurement points (intensity at a given time) can be obtained by sampling a detector at a data acquisition rate. This same data acquisition rate can be used to determine the basis functions used to generate the first set of mass functions. If a different data acquisition rate is used, the mass functions can be modified, e.g., by interpolation to add more measurement points, or measurement points can be dropped, depending on whether the data acquisition rate is higher or lower for the current mass analysis. The detection vector y can be stored on a computing device for analysis.

Accordingly, at this point, the detection vector y will comprise intensity values at measurement times during the scan. For example, the number of measurements may be hundreds of thousands, one million, 2 million, 5 million, 10 million, or more. The detection vector y would have the same time between measurements as the time between values of a mass function. The mass functions can be defined to be a same length as detection vector y, or they can be stored in a sparse manner, as most values of a mass function will be zero. That is, a mass function corresponds to a specific mass, which would be ejected over a relatively short time frame compared to the total scan time. Thus, a mass function can be stored as a set of intensity values starting at a particular absolute time of the scan.

At block 830, the first set of mass functions corresponding to the scanned mass range is obtained, e.g., read from memory or generated on-the-fly. The mass functions correspond to a first plurality of mass-to-charge ratios over a first range of mass-to-charge ratios (i.e., the scanned mass range, which occurs of a scan time range). Each mass function corresponds to a different mass-to-charge ratio. The first set of mass functions comprises J subsets of N basis functions, wherein each subset of N basis functions is shifted from another subset of N basis functions by a multiple of the common period. Other subsets can be partial subsets, e.g., at the beginning and end of the mass range. Thus, the first set of mass functions can comprise J+2 subsets. The first set of mass functions can be generated as described for FIGS. 6 and 7.

At block 840, optimal values are computed of a composition vector s that provides the detection vector y as a linear combination of the first set of mass functions. Each value of the composition vector s corresponds to one of the mass functions. For example, the composition vector s can specify that certain mass functions do not appear in the detected data (i.e., the detection vector y) by having certain values of the vector be zero. The zero indicates that none of the certain mass functions contributed to the detection vector y, which indicates that no ions with the corresponding mass were detected. Other values of composition vector s can indicate the mass functions that do contribute to the detection vector y, which indicates that ions with the corresponding mass were detected. Relative amounts of the detected ions with different masses can be indicated by the relative values in the composition vector s corresponding to the mass functions. Accordingly, the composition vector s specifies the amounts of ions having the first plurality of mass-to-charge ratios that were detected.

At block 850, the mass spectrum is determined based on the composition vector s. In some embodiments, the mass spectrum can be taken directly as the composition vector s. In other embodiments, the values of the composition vector s can be analyzed further. For example, the values can be analyzed to determine if one mass peak exists in the middle of two mass functions. The weighted mean of the masses (e.g., weighted by the corresponding s values) can be used to determine the mass for two neighboring values of composition vector s. In other embodiments, the non-zero values can be analyzed further using continuous functions to determine a more accurate mass, which is described below in more detail.

B. Depiction of Mass Functions and Solution

In some embodiments, block 840 may be solved using matrix equations. Such a set of matrix equations is depicted in FIG. 9.

Figure 9:
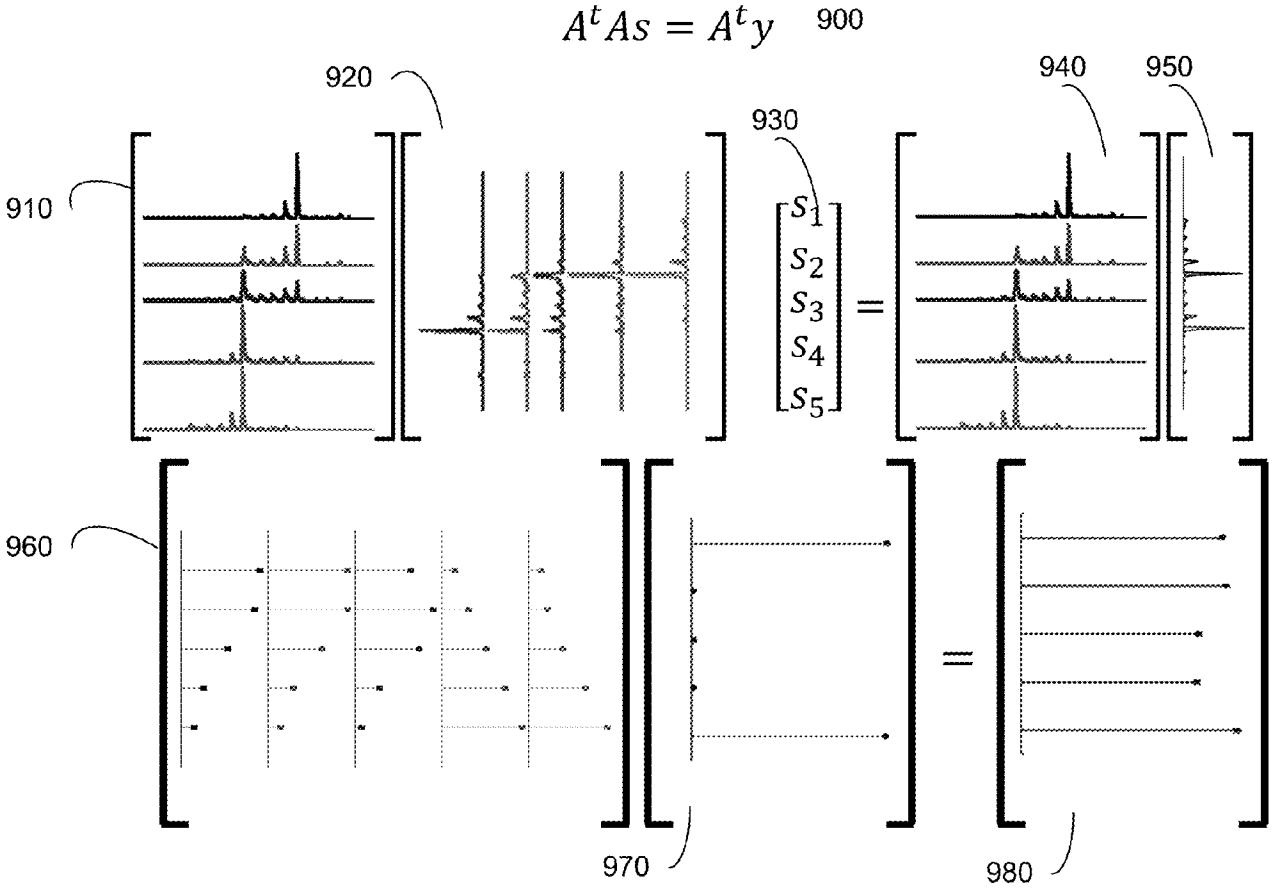
FIG. 9 illustrates a technique of solving for the composition vector s according to embodiments of the present invention.

FIG. 9 illustrates a technique of solving for composition vector s according to embodiments of the present invention. FIG. 9 shows a matrix equation 900 is operable for solving the composition vector s to determine the amount of ions of different masses analyzed based on the raw detection data (detection vector y). The matrix A and it transpose $A^t$ corresponds to the set of mass functions.

Box 910 shows the mass functions as a set of measurement points. For ease of illustration, box 910 shows values for five mass functions, but many more mass functions would be used (e.g., 40,000 to 50,000 mass functions can be generated from 10-100 basis functions). Each row of matrix $A^t$ corresponds to a different mass function, and thus corresponds to a different mass. The columns in matrix $A^t$ correspond to the intensity values at the measurement times. As described above, the measurement times relate to a data acquisition rate. When a large number of mass functions are used, matrix equation 900 can be broken up into smaller equations. For example, for a scan rate of 0.1 Da/usec and a scan range of 1000 Da, the problem can be broken up into time intervals corresponding to, for example, 10 Da, which can correspond to 400 to 4,000 mass functions and is a reasonably sized problem. The time intervals can overlap so that spectra of masses at the end of one time interval can be combined with spectra of masses at the start of a next time interval, thereby providing the correct answer at the boundaries.

As shown, the mass functions have regions (i.e., regions in time) where intensity values are zero and regions where the mass functions have nonzero values. The mass functions of the same common period may overlap (and potentially overlap with mass functions of the neighboring common period), but mass functions of common periods that are separated in time would have nonzero values for some different times. The matrix $A^t$ can be stored as a sparse matrix, where only nonzero values are stored, e.g., by storing a starting time (column) for each mass function in a total number of times (columns) which data values is stored. The stored data values may be zero, e.g., when the zero value occurs between nonzero values.

Box 920 shows matrix A. Box 930 shows composition vector s. The length of detection vector s is equal to the number of rows of matrix $A^t$. Thus, each value of composition vector s specifies a contribution of the corresponding mass function in box 910. Box 940 shows matrix $A^t$.

Box 950 shows detection vector y. The length of detection vector y equals the number of columns in matrix $A^t$. An optimal linear combination of mass functions will provide a best fit to detection vector y. The optimal linear combination is provided by the composition vector s that solves matrix equation 900 exactly, or most nearly solves the equation via an optimization that minimizes an error of the linear combination relative to the detection vector y.

Box 960 corresponds to a square matrix (autocorrelation matrix) that results from the matrix multiplication of $A^tA$. The dimensions of the resulting matrix correspond to the number of mass functions. The matrix elements correspond to an overlap of the matrix functions with each other. Thus, the diagonal would correspond to one if the mass functions are normalized. The square matrix would be sparse as mass functions of very different masses would not overlap with each other. The values of each of the matrix elements are depicted by the length of the corresponding line.

Box 970 shows a solution for composition vector s. The size of the contributing values for each of the five depicted mass functions is illustrated by the length of the corresponding line. Box 980 shows the result of the matrix operation $A^ty$. This operation corresponds to determining an amount of overlap of each mass function with the detected data. The resultant cross-correlation vector in box 980 shows a level of overlap of each mass function with the detected data. In one embodiment, composition vector s can be solved by inverting the autocorrelation matrix in box 960 and multiplying the inverse by cross-correlation vector 980 to obtain composition vector s.

V. Reproducibility

For the mass functions to be assigned to the correct masses, the scanning procedure needs to start at a specific time. In this manner, embodiments can know that a particular mass function is to have a first subpeak at a particular time, a second subpeak at a particular time, etc. And, thus the mass function for the micropacket pattern of a particular mass can be determined as long as the system is calibrated such that the start of the scanning procedure starts with a mass that corresponds to the very first mass function in the set of mass functions. As described above, the starting mass is not needed to be exactly the same as the mass of the very first mass function, but may be within the resolution specified by the number of basis functions in the common period. When the prescribed start time is used, ions with a particular mass will always appear with a known pattern starting at a specific time, i.e. a mass at a position always has a particular shape defined by the corresponding mass function.

For the ions of a particular mass to have the same micropacket patterns, the same trapping and excitation frequencies are used, as well as the same phase shift. Embodiments can phase lock the trapping voltage and excitation voltage, so that the periodicity of the two signals coinciding maintains a fixed value. For example, as shown in FIG. 3, the locking provides a periodicity of three wavelengths of the trapping voltage (i.e., the excitation frequency is ⅓ the trapping frequency).

A. Phase of the Common Waveform at the Start of Mass Analysis

The starting common phase can be determined in the following manner such that the correct set of mass functions can be generated and identified as corresponding to the correct times in the scanning procedure. In some embodiments, the starting common phase can be controlled to always be the same for a same starting mass.

The following detection and estimation procedures use the ability to characterize the mass spectral peaks over the common period $p_c$. In order for this characterization to be useful, the common phase $\phi(t)$ should have the same value for the mass m every time it is analyzed. We can give a relation for the desired common phase $\phi_d(m)$ of the common waveform as a function of the mass scale, where r is the mass analysis scan rate in Th per second, and m is mass in Thompsons. For example, $$\phi_d(m) = \frac{2\pi}{p_c}\frac{m}{r} + \phi_0.$$

The common phase offset is $\phi_0$. The function $\phi_d(m)$ should give the common phase that the common waveform has for any mass m during the initial characterization of the peak shapes.

Due to the nature of the QIT experiments, the time between turning on the trapping voltage and the start of the mass analysis is likely to be variable. The QIT is a versatile device capable of many experiments, each of which can take a variable amount of time. Additionally, ions are typically allowed to fill the ion trap for a variable amount of time depending on the sample concentration and ion generation rate of the ion source. Finally, the QIT can be configured to do mass analysis over a variable range of masses. The delays due to these factors can be determined via techniques known to one skilled in the art.

Each of these factors changes the actual phase $\phi_a$ (t) of f (t) at the start time t of mass analysis such that it coincides with the 'desired' phase used during calibration, $\phi_d$ (m), only randomly, and with extremely low probability. Therefore, the peak shapes are random in traditional ion trap mass analysis.

$$\phi_a(t) = \frac{2\pi}{p_c}(t - t_0) + \phi_0$$

B. Synchronizing (Calibration of Timing)

This situation can be remedied by adding a small amount of time (determined from the various factors mentioned above), before mass analysis and after any variable time procedures, equal to $t_d(m, t)$, or phase increment $\Delta\phi(m, t)$:

$$t_d(m, t) = \frac{p_c}{2\pi}\Delta\phi(m, t) = \frac{p_c}{2\pi}(\phi_d(m) - \phi_a(t)).$$

Since cos ($\phi(t)$)=cos($\phi(t+2\pi k)$), $k \in \mathbb{Z}$, the actual phase $\phi_a$ (t) can be placed in the range $0 \le \phi_a(t) < 2\pi$ by adding or subtracting an integer multiple of $2\pi$ to any $\phi_a$ (t). Therefore without loss of generality, we can set $$\phi_a(t) = 2\pi\left(\frac{\phi_a(t)}{2\pi} - \left\lfloor\frac{\phi_a(t)}{2\pi}\right\rfloor\right).$$

To ensure the non-negativity of $t_d(m, t)$, we take $$\Delta\phi(m, t) = \begin{cases} \Delta\phi(m, t), & \Delta\phi(m, t) \ge 0 \\ \Delta\phi(m, t) + 2\pi, & \Delta\phi(m, t) < 0 \end{cases}.$$

In other embodiments, since modern waveforms can be generated via direct digital synthesis, it is possible to digitally rotate the phase of the trapping waveform to set $\phi_a(t)=\phi_d(m)$ at the start of mass analysis. The digital rotation can occur by using direct digital synthesis, where a certain waveform period corresponds to a certain number of clock ticks of some reference clock. For example, a 16 bit register has 65536 possible values in a period. A register corresponds to the current phase of the output, and on each clock tick, the register is incremented by a certain amount until at the waveform period (65536) the counting wraps around and starts from 0 again. The size of the increment controls the amount of time until you come back to 0, i.e. the frequency of the signal. Thus, when we want to start the mass analysis scan, one could arbitrarily set that register to the value that gives a certain phase of the waveform. However if the voltage is already on, this is likely to cause a huge spike in the actual physical waveform, when the analog circuitry reacts to this sudden change. Instead, one can change to the desired phase with a certain gradual ramp of the register increments. For example, instead of the usual increment A, the increment can change with some function A +D(t), where the delta from the usual increment is a function of a ramp time that changes the phase to the desired value.

In yet another embodiment, a small change of frequency of $\Omega$ or $\omega$ for a fixed amount of time could also achieve the same result. The change in the frequency would allow one to control the starting common phase to be a desired value at the time the scan is started. However, this technique is complicated by the fact that the same phase shift between waveforms needs to be maintained.

Accordingly, a process can be performed to synchronize the waveform phases and then begin scanning the trapping amplitude, where the ramping starts at a specific phase shift of the signals. The system can change the phase relationship until the phase lock is achieved to obtain the same phase shift as when the basis functions were determined. And, the scanning can start at a specific point in the cycle of the common period. As part of the phase locking, the trapping signal would always be at the same point in its cycle relative to the same point in the cycle of the excitation signal. Thus, if the scan starts at a same point in the common period (which may equal the excitation period), then the mass functions would be synchronized with the ions of the corresponding mass.

As different mass ranges can be scanned, a scan is not always started from the same amplitude of the trapping signal. As described above, a certain amount of time can be waited to make sure that the scanning starts at the proper amplitude and the proper point in the common period. The starting amplitude can also be varied to ensure that the same amplitude is achieved at a particular point in the common period.

VI. Solving for S

The composition vector s can be determined in various ways. For example, the matrix equation in FIG. 9 can be solved exactly, e.g. by computing an inverse of $A^tA$. Other embodiments can iteratively solve As=y, e.g., using least squares as a measure of error and an optimization technique that minimizes error. Such techniques may include constraints such as non-negativity constraints. Other digital processing techniques can also be used.

A. Cross-Correlation

Digital signal processing techniques for detection and estimation of real-world signals in the presence of noise are well known. One widely used technique is the so-called "matched-filter" method which gained popularity in the radar, GPS, and cell-phone communities (Proakis and Manolakis, Digital Signal Processing: Principles, Algorithms, and Applications 2007), because of the ability to extract usable signals from noisy data.

In this method, a known, discrete time signal x[n] is converted to an analog time signal and transmitted, and reflections from targets at an unknown distance (in the radar example) are contained in the received, sampled signal y[n]=ax[n−d]+v[n], where a is a scalar coefficient, d is a time delay, and v[n] is independent, identically distributed random noise. The received signal y[n] is passed through a matched filter (i.e. it is convolved with x[−l], the time reverse of the signal of interest). This operation is called the cross correlation of y[n] and x[n], denoted $r_{yx}[l]$. In this case, $$\begin{aligned} r_{yx}[l] &= y[l] * x[-l] \\ &= (ax[l-d] + v[l]) * x[-l] \\ &= ax[l] * x[-l] * \delta[l-d] + x[l] * v[-l] \end{aligned}$$

$$r_{yx}[l] = ar_{xx}[l-d] + r_{xv}[l]$$

Because the noise v[n] is only randomly correlated with x[n], it is filtered down to a reduced level in $r_{yx}[l]$, while the shifted and scaled autocorrelation of the known signal of interest $ar_{xx}[l-d]$ remains. The scaling factor a and delay d can be estimated with standard linear algebra methods.

Figure 10A:
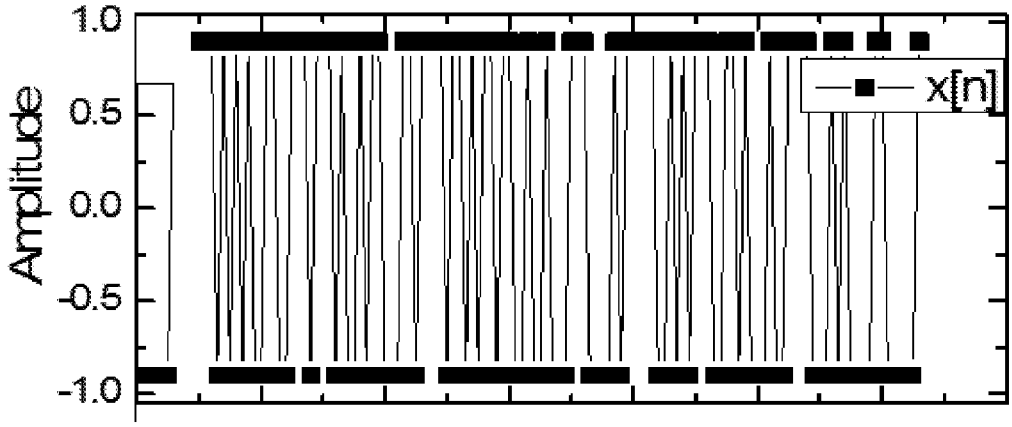
FIGS. 10A-10C show an example of signal detection using a matched filter, with FIG. 10A showing the transmitted signal, FIG. 10B showing the received signal, and FIG. 10C showing the cross correlation of received signal with transmitted signal.
Figure 10B:
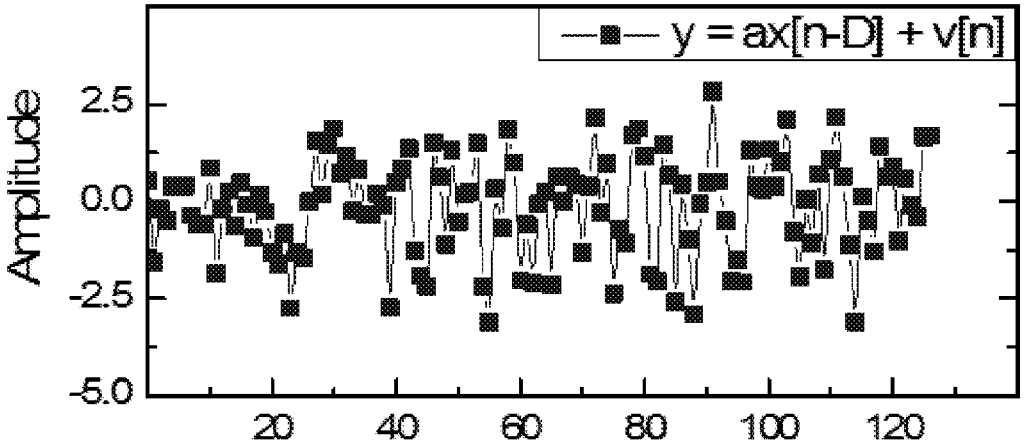
Figure 10C:
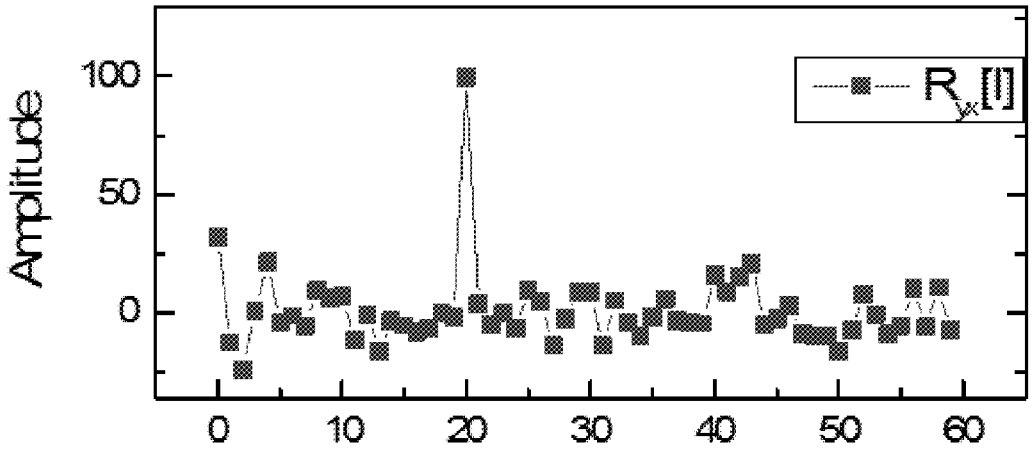

FIGS. 10A-10C show an illustrative example of matched filtering. FIG. 10A shows the transmitted signal x[n]. FIG. 10B shows the received signal with noise added such that the transmitted signal is not distinguishable by eye. FIG. 10C shows the result of the cross correlation $r_{yx}[l]$, where the scaled, shifted autocorrelation $ar_{xx}[l-d]$ is clearly visible above the noise.

The matched filter scheme can be used for ion trap peak detection, with the caveat that the matched filter x[−l] should be a periodic function of the discrete time delay l. Whereas the standard cross correlation operation is defined as $$r_{yx}[l] = y[l] * x[-l] = \sum_{k=-\infty}^{\infty} y[k]x[k-l].$$

Ion trap peak detection can use:

$$r_{yx_{\phi(lT_s)}}[l] = \sum_{k=-\infty}^{\infty} y[k]x_{\phi(lT_s)}[k-l],$$

where $x_{\phi(lT_S)}$ [n] is the peak shape generated at phase $\phi(lT_S)$ of the common waveform, and where $$\phi(lT_s) = 2\pi\left(\frac{lT_s}{p_c} - \left\lfloor\frac{lT_s}{p_c}\right\rfloor\right).$$

Thus, the ion trap cross-correlation function is the series of dot products of the stored library spectra $x_{\phi(lT_S)}[n]$ with the sampled mass spectral signal y[n]. The $x_{\phi(lT_S)}[n]$ can correspond to a basis set of basis functions, which can be used to generate mass functions.

B. Matrix Operations

As described in section III, embodiments can obtain a series of spectra (micropacket patterns) for a calibrant mass at different delays $\phi(t)$ that span the common waveform period $p_c$. These spectra correspond to the basis functions, which can be used to generate mass functions for the total mass range. The solution for the total mass range can be broken up into separate matrix equations of more manageable size. Thus, As=y can be solved for a subrange of masses. The subranges (corresponding to a time interval in the total mass scan) can overlap and solutions combined to obtain correct values of composition vector s at the boundaries of the time intervals.

Figure 11:
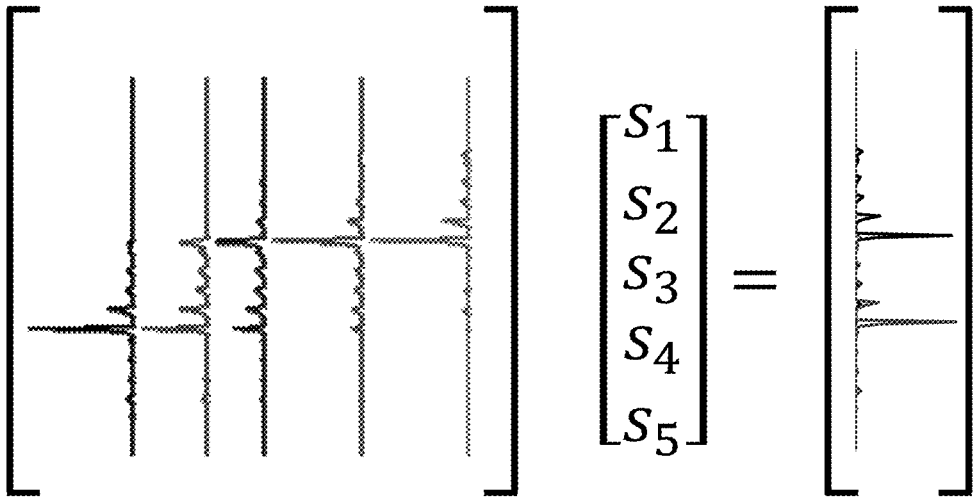
FIG. 11 shows the detection of two unknown components in y using a library of mass functions A according to embodiments of the present invention.

FIG. 11 shows the detection of two unknown components in y using a library of mass functions A according to embodiments of the present invention. These mass functions form the columns of the matrix A, as depicted in FIG. 11. For ease of illustration, mass functions of just one common period are shown (and thus are equivalent to basis functions $x_\phi$ for the one common period). An acquired set of data comprising signals with unknown intensities is contained in the vector y at times dictated by a data acquisition rate. The object of detection is to determine the presence and abundance (contribution) of ions of particular masses corresponding to the mass functions in each column of A, where the abundances are represented by the values $s_i$. One widely used technique for solving this problem is the method of least squares. A non-negative method is especially applicable because a negative abundance is not applicable, since there cannot be a negative amount of ions.

FIG. 12 shows a technique using matrix multiplications of mass functions to determine an abundance of ions in a detected signal from an ion trap device according to embodiments of the present invention. Specifically, FIG. 12 shows a solution to system of equations As=y showing detection of the first and last library signals in the input data y.

The technique proceeds by multiplying both sides of the equation in FIG. 11 by the transpose of A on the left hand side (as in FIG. 9), which in effect converts the library of spectra A into a library of autocorrelation functions. The result is a square matrix 1210. On the right side of the equation, the multiplication by the transpose of A on the left hand side provides a cross correlation of the input data y with the library of mass functions, as depicted in matrix 1220.

In the more simple problems where the columns of A are all shifted versions of each other, $A^tA$ contains the autocorrelation functions $r_{xx}[l-d]$. In that case, $A^tA$ can be padded to form a so called Toeplitz matrix, and this system can be solved in O(n) log n time using fast Fourier transforms. Because our library spectra are each different (i.e., basis functions in a basis set differ from each other), other matrix methods, but for reasonably sized problems this is not an issue. For example, for n=1000 (n being the total number of data acquisition points for the subrange) with m=100 columns (m is the number of mass functions for the subrange), this problem, including the non-negativity constraints, can be solved in ~2 ms on an embedded computer, as was done in a prototyping experiment. Several parts of the problem can be solved ahead of time, such as formation and inversion of $A^t$.

In FIG. 12, the matrices are left in their places, and depict the solution to the problem in the last row, where the vector s has abundance in the first and last index, denoting the presence of the first and last library spectra, and thus the presence of the first and last mass. In a real application, the detection of all the signals in a spectrum will likely use a larger A matrix that spans multiple periods of the common waveform period. However, the pattern of spectra repeat, so an initial characterization of peak shapes is sufficient to populate the rows of A for many cycles, as is described herein.

Since it is known that the width of ion trap peaks increases as a function of m/z, the determination of the basis set for a common waveform period can be repeated at several points along the m/z scale to obtain better accuracy. Alternatively, if the mass analysis RF amplitude uses an exponential instead of linear ramp, given the abscissa units of Matheiu q instead of m/z, it may be possible to obtain a nearly constant peak width as a function of m/z, requiring fewer library matrices $A_i$, e.g., as described in U.S. Pat. No. 8,389,929, which is incorporated by reference in its entirety.

C. Test Detecting Mass Functions

The method of FIG. 12 was applied to a larger scale problem, that of detecting the various peaks in the library. This is the minimum requirement of any such technique; that it be able to detect the columns of its own matrix when input as y vectors in FIG. 12. Five separate y vectors were used (each for a different mass), and a solution was obtained for each y vector.

Figure 13:
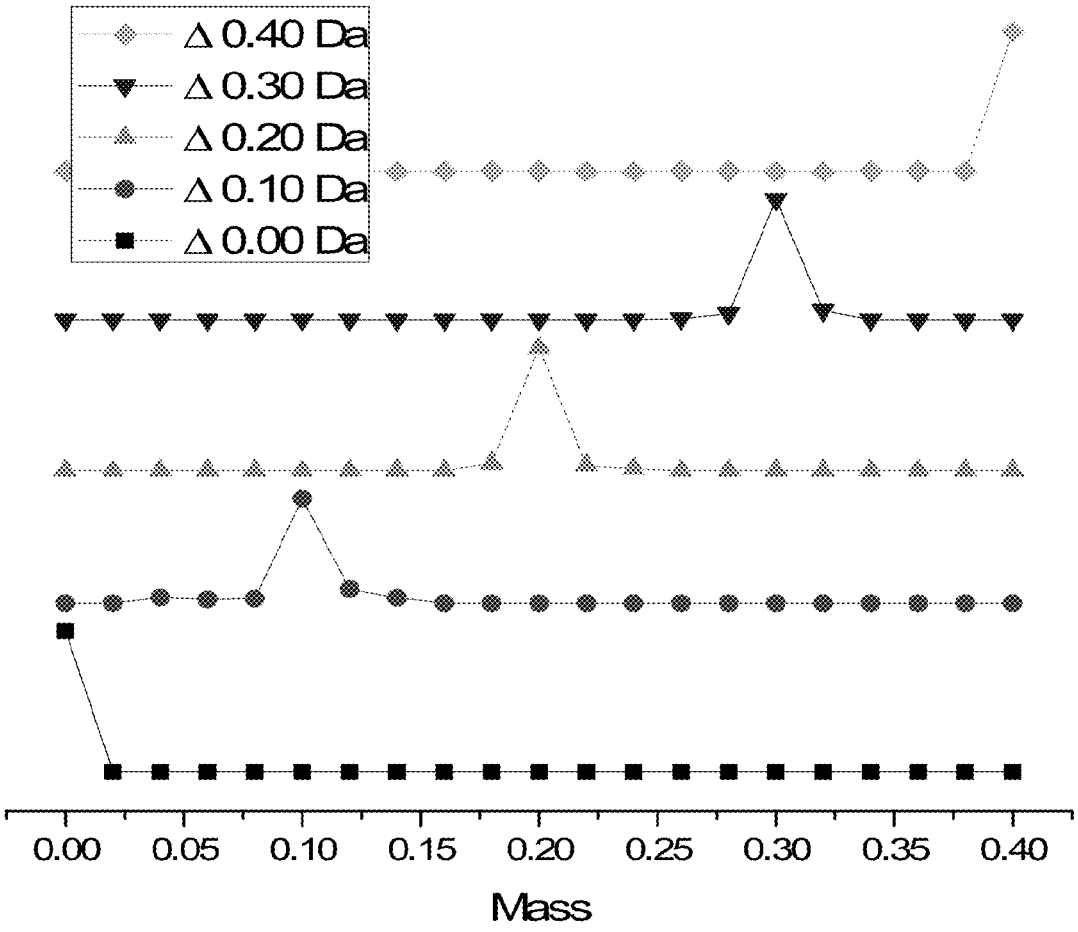
FIG. 13 shows a detection of mass functions in the library using simulated measurement points in a detection vector.

FIG. 13 shows a detection of mass functions in the library using simulated measurement points in a detection vector. The simulation measurements points correspond to the expected detection vector as determined via computer simulation, which has been shown to match experimental data. The results of such a test demonstrate that the library of mass functions are in fact detected at the correct positions, which is seen in FIG. 13. The horizontal axis is mass. Each of the plots correspond to the composition vector s for a different simulated scanning procedure, where the detection vector corresponds to one mass function.

There is essentially zero signal at indices other than the correct ones, and the sum of the non-zero points is the area of the input peak, when the columns of A are normalized to their vector norm. These data were produced from an analysis using 100 kDa/s scan rate for the simulation, for which separation of peaks spaced by even 0.5 Th is a challenge for traditional techniques.

VII. Determination of Actual Spectrum from S

The composition vector s specifies the abundance of each mass function in the detected signal, and thus corresponds to the abundance of the actual ions. Ideally, a value of composition vector s would have neighboring values of zero or close to zero. But, the composition vector s may not correspond exactly to the mass spectrum depending on the resolution of the mass function used. For example, non-zero abundance values may exist in composition vector s for neighboring basis functions. This could result from ions of those two neighboring masses being detected, but it may result from ions of one mass that is between the two neighboring masses. Accordingly, such a process of determining the correct mass spectrum can be dependent on the separation in mass of the different mass functions (i.e. the resolution).

In such situations, one can analyze the values of composition vector s to determine which masses correspond to the s values. For example, if two neighboring values of composition vector s are appreciable (e.g., above a threshold) and other values in the vicinity are less than a threshold, embodiments can identify a single mass that is determined by a weighted average (e.g., by the s values). Such a scenario can happen when ions have a mass that falls exactly in between two mass functions, which would result in the s value for each being of approximately equal value.

Accordingly, in some embodiments, the abundance values in the composition vector s of FIG. 12 can be used as the new mass spectral axis, i.e. as the mass spectrum. However, in other embodiments, a centroiding or parameter estimation procedure can be used to group points together as belonging to the same m/z species. One approach uses heuristics to search for valleys between local maxima in the composition vector s and knowledge of the resolution of the instrument to group points together and compute a centroid position as the mass of the ion peak. The intensity for the ion peak can be computed from thearea under the curve determined from non-zero values of the composition vector s corresponding to the ion peak multiplied by the corresponding basis function.

Other embodiments can use other means though of estimating these parameters, especially when the data can be described with an analytical model. In these cases, gradient optimization techniques can be used to find the parameters that minimize an error function between model and data. In the case where multiple peaks are overlapping, a poor minimum error score would result, and an additional mass function could be added to the model to attempt to obtain a lower error. An example of obtaining greater accuracy for one peak is described below. For two peaks, the twice the number of parameters can be used.

The additional mass function can be determined using an analytical model for the mass functions. One approach for making an ion trap peak model is to consider how the intensity of the micropacket pattern at a fixed time changes as a function of mass, or as a function of the fractional common waveform phase $\phi$. Thus the model could be given as $$ax(\phi) = a\sum_{k=0}^{n-1} m_k(\phi)$$

where a is an abundance scaling factor, and $m_k(\phi)$ is the function describing the intensity of the $k^{th}$ micropacket of the peak as a function of $\phi$. Optimally, $m_k(\phi)$ would have a convenient function, such as $$m_k(\phi)=e^{(\phi-\phi(k))^2/2\sigma^2}$$

and $\phi(k)$ is the phase center of this micropacket. Such a function can modulate the micropacket patterns, and thus $m_k(\phi)$ is not directly the micropacket pattern of a mass spectral peak, but can be used to construct a model peak signal, by specifying the micropacket heights at a given time (or $\phi$)

Figure 14A:
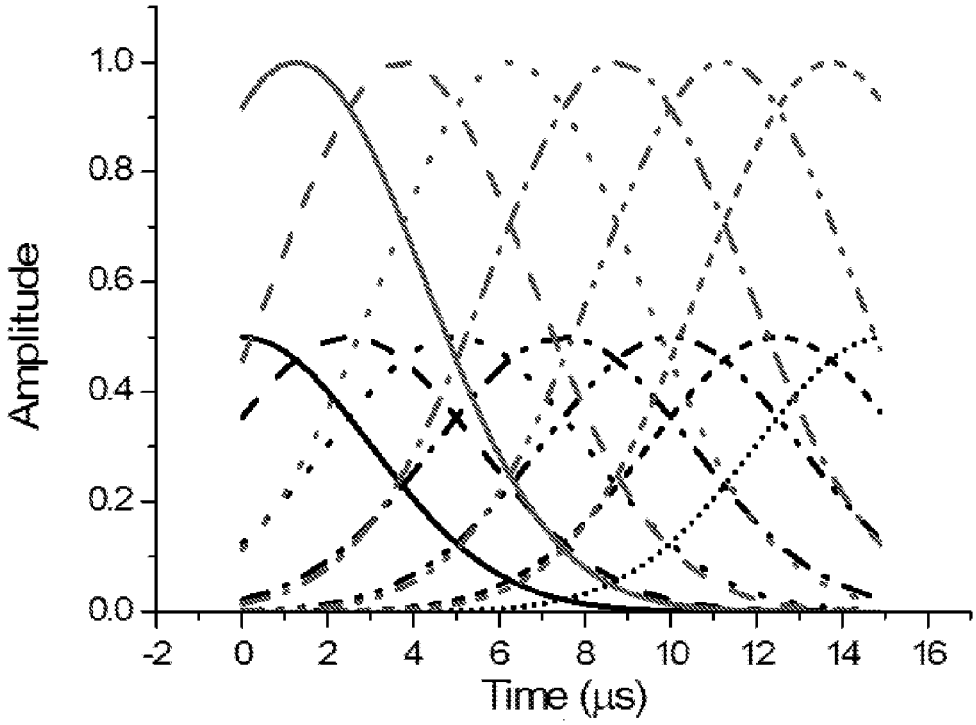
FIGS. 14A and 14B show an example of determining a new mass function at any mass from nearby mass functions according to embodiments of the present invention.
Figure 14B:
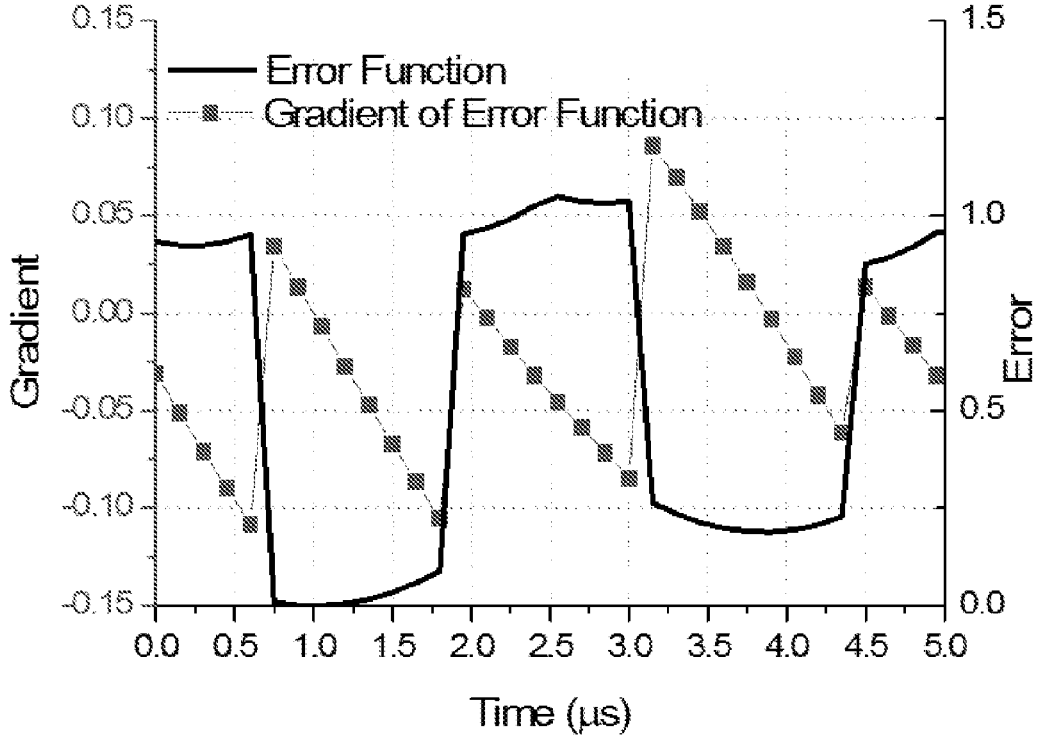

FIGS. 14A and 14B show an example of determining a new mass function at any mass from nearby mass functions according to embodiments of the present invention. In this example, consider a fictitious mass function centered at 1 μs after the start of the common waveform. This peak could be constructed from the heights of the micropacket patterns (basis functions) having appreciable intensity at t=1 μs.

FIG. 14A shows micropacket intensities of a fictitious ion trap where $m_k(\phi)$ is Gaussian, and $m_k(\phi)$ has the above form for the micropacket intensities. Two different fictitious micropackets of different intensities are shown. The functions change their center in accordance with $\phi(k)$.

FIG. 14B shows an error and error gradient for model functions centered at the indicated times, for an actual peak at 1 μs. As the parameter $\phi$ is varied, the error between the signal and the model $ax(\phi)$ is shown in FIG. 14B, where a was re-estimated each time. This experiment shows that given an initial guess of the peak position between 0.75 μs and 1.75 μs, an optimization can find the position of minimum error, where the error gradient is 0, at t=1 μs. This technique uses the ability to characterize the function $m_k(\phi)$.

If one knew the range over which the mass might be, embodiments can use the analytical formulation for the micropacket pattern to determine the phase for the best fit to the detection vector, where the optimal phase corresponds to the best estimate for the mass. The phase comprises a continuous parameter that can be optimized to determine the optimal mass function, which provides the optimal mass. Other functions can be used for the modulation function besides Gaussian, e.g., modulation functions with a longer tail. More complicated functions can have more than one parameter, e.g., five parameters. A test was performed as follows.

Figure 15:
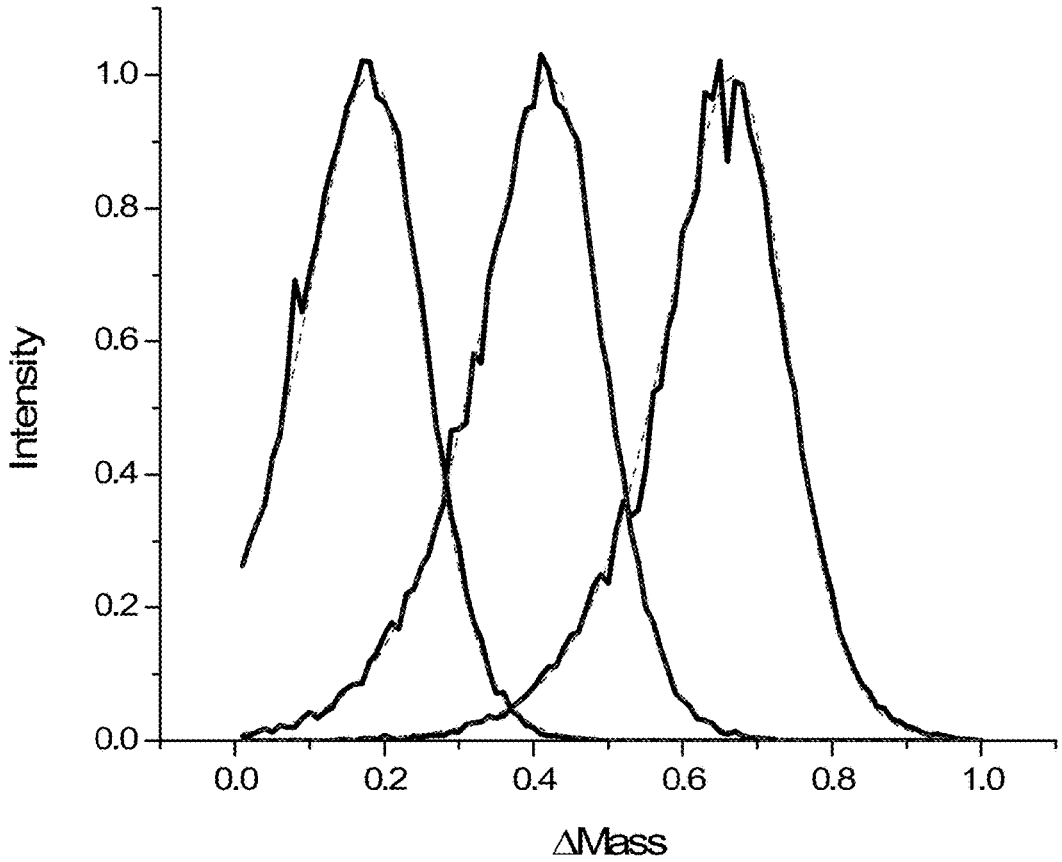
FIG. 15 shows simulated micropacket intensities for ejection at $\beta$=⅔, where spectra were acquired for ions of m/z 524 to m/z 525, and the intensities of three micropacket patterns were extracted.

FIG. 15 shows simulated micropacket intensities for ejection at $\beta=2/3$, where spectra were acquired for ions of m/z 524 to m/z 525, and the intensities of three micropacket patterns were extracted. The vertical axis is intensity. The horizontal axis is a difference in mass. Spectra were simulated in increments from m/z 524 to m/z 525 using $\beta=2/3$ ejection to gather data covering several periods of the common waveform. These data gave a function that was not quite Gaussian.

Three selected micropackets were extracted, and fit to a 5-parameter asymmetric Gaussian relation used in chromatography, shown in FIG. 15. Although not as convenient as a Gaussian, this function has closed form derivatives, and so would be a candidate for implementation as the basis for our ion trap peak shape model. The non-symmetric nature of the actual $m_k$ ($\phi$) has to do with non-idealities of the resonance ejection process, and we have shown that the characteristics of this shape can be changed with simple geometric modifications. Therefore given enough motivation, it should be possible to optimize the geometry of an ion trap such that $m_k$ ($\phi$) was more Gaussian.

VIII. Scanning Two Masses at the Same Time

In some embodiments, two excitation frequencies can be used at the same time, thereby ejecting ions of two different masses at the same time, which is described in U.S. Pat. No. 5,285,063. The signals for each excitation frequency would be measured at the same time, since the ions would be ejected at the same time. But, given that the excitation frequencies are different, the mass patterns would be different, as the intersections of the excitation frequency with the same trapping signal would be different. The common period of the basis functions would be different for each excitation frequency. As the common period is different, the number of micropackets can be different. And, the distance between the micropackets can reflect the frequency of the excitation signal.

In this manner, two mass ranges can be scanned simultaneously, e.g., 0-500, and 500-1,000. The subranges can be of different sizes. The solution of the composition vector for the total mass range (e.g., composed of the two subranges) can be determined in various ways. In one embodiment, the spacing between the subpeaks can be used to determine which data corresponds to which excitation frequency, and two separate composition vectors can be used.

In another embodiment, mass functions can be generated from the two separate basis functions (i.e., one basis set for each excitation frequency). The mass functions from the two separate basis sets would overlap, but that does not cause complications for the solution, e.g., as depicted in FIGS. 9, 11, and 12. Since the masses are different, the values in the composition vector s from the ions at the other frequency would be negligible. Thus, a time for scanning a total mass range can be decreased by the number of excitation frequencies used (e.g., two or more excitation frequencies).

IX. Data Acquisition Rate

The data acquisition rate can impact the accuracy of the mass spectrum that is determined. The following analysis shows how the data acquisition can impact the accuracy.

Figure 16A:
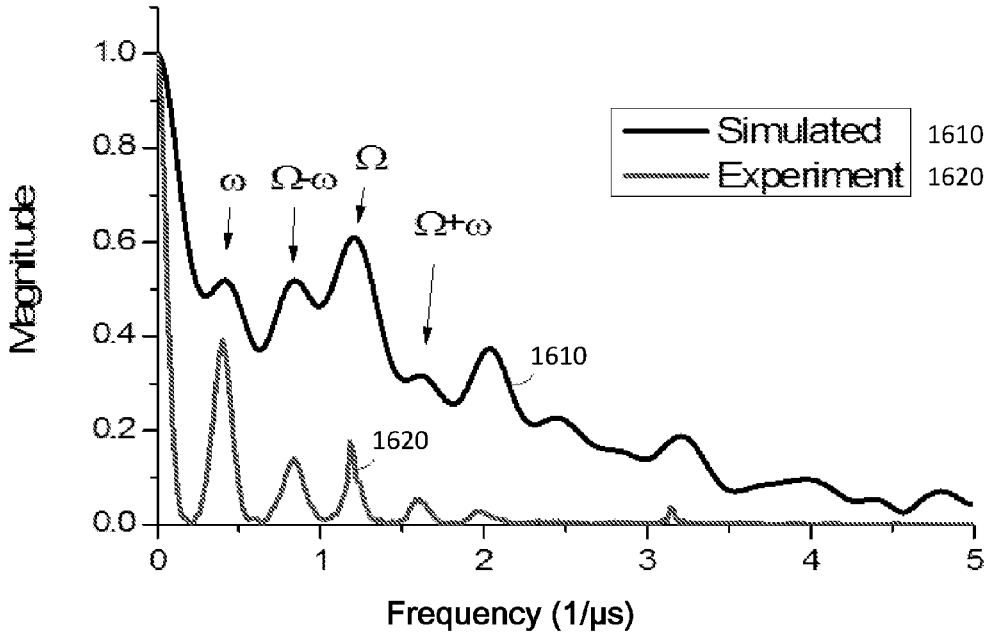
FIGS. 16A and 16B show a frequency analysis of simulated and experimental ion trap spectra using ejection at a) $\beta$=⅔ and b) $\beta$=⅘.
Figure 16B:
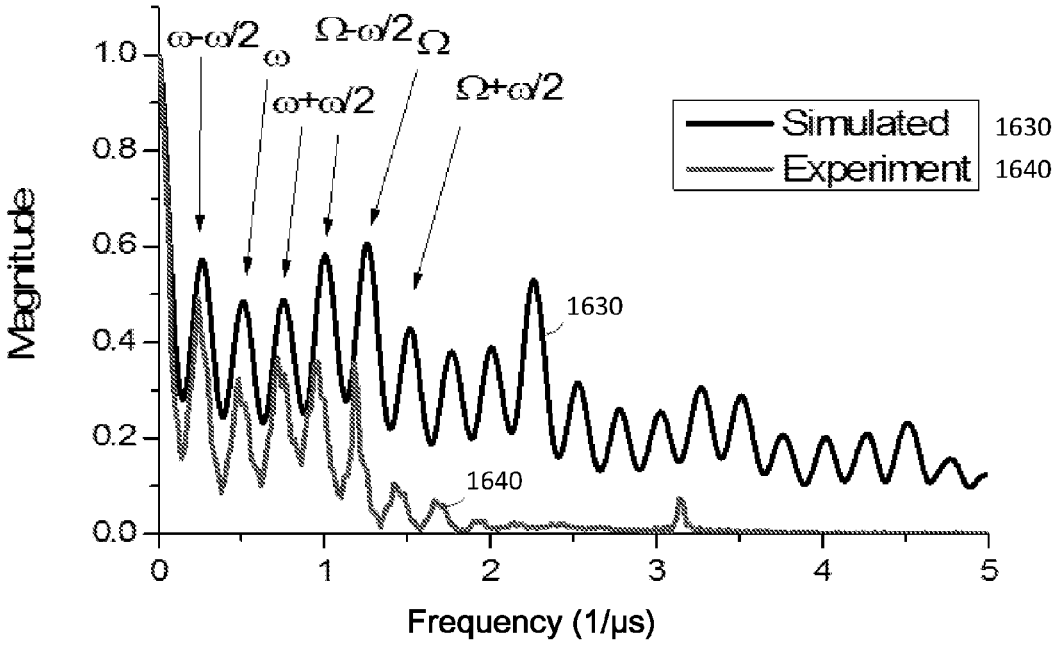

FIGS. 16A and 16B show a frequency analysis of simulated and experimental ion trap spectra using ejection at a) $\beta=2/3$ and b) $\beta=4/5$. The vertical axis is the magnitude of a frequency component of the detected micropacket pattern. The horizontal axis corresponds to the frequency value. Results are shown for simulated micropacket patterns 1610 and 1630 and for experimental micropacket patterns 1620 and 1640.

The frequency analysis of the micropackets patterns shows that the majority of the signal energy is in the region below twice the trapping frequency $2\Omega$, such that to reduce/eliminate aliasing, the acquisition rate should be on the order of $2\Omega$ to $4\Omega$, where $4\Omega$ would be the Nyquist rate. This analysis is true for both ejection at $\beta=2/3$ and $\beta=4/5$ in FIGS. 16A and 16B, respectively. Note that the sharp peaks observed in the experimental traces at 1.187 and 3.3 are artifacts due to insufficient shielding of the detection system from the trapping waveform and a multipole ion guide waveform, respectively.

Normally, ion trap mass spectrometers might sample at a fraction (e.g., 0.3 or 0.03) of the trapping frequency, which is why peaks normally look smooth. But, the micropacket patterns have higher frequency content, and thus $2\Omega$ would likely not be sufficient (e.g., to capture 95% of the signal). If different trapping and excitation signals were used, then the data acquisition rate can change, mostly due to the trapping frequency used.

X. Computer System

Figure 17:
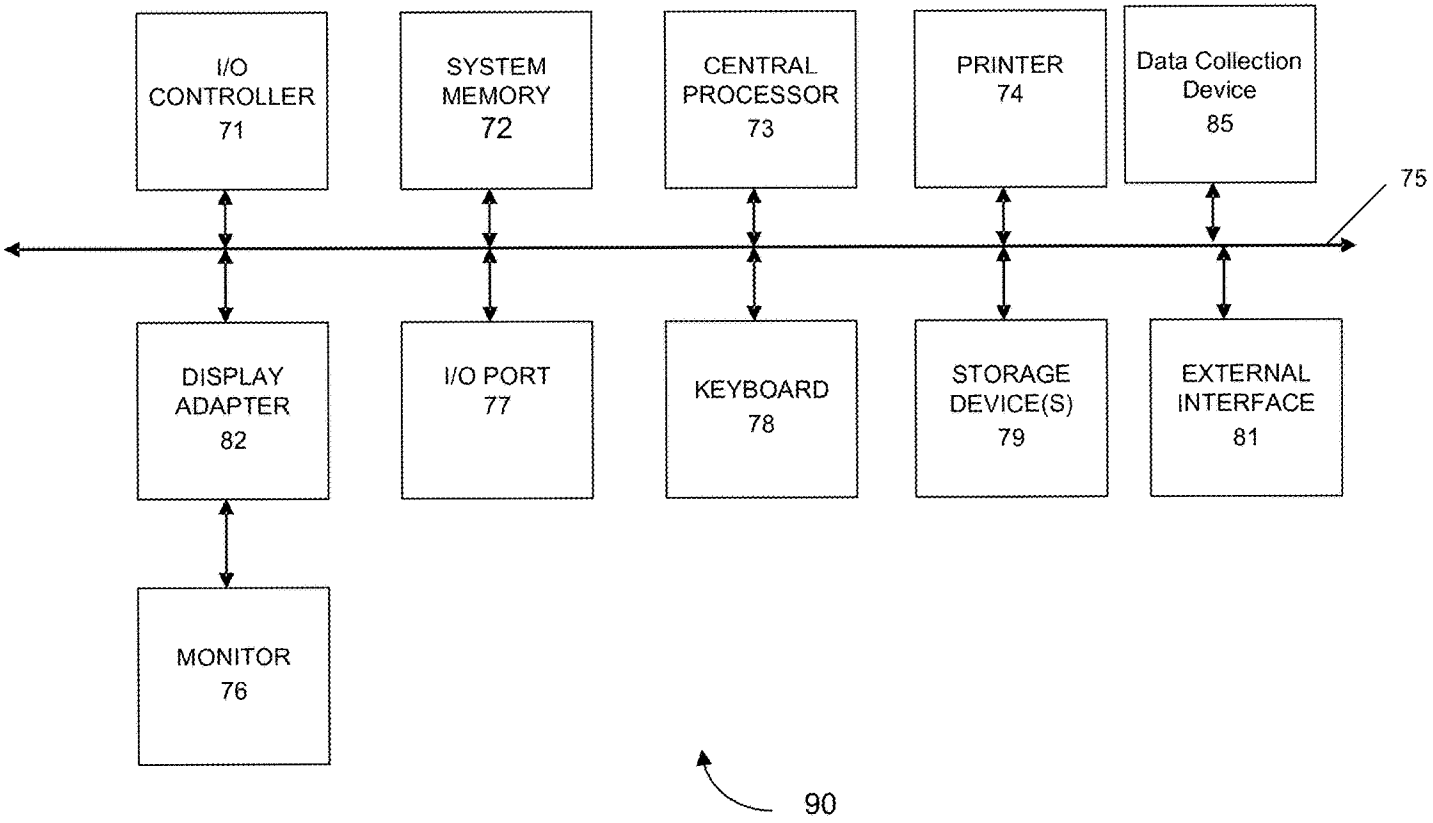
FIG. 17 shows a block diagram of an example computer system 10 usable with system and methods according to embodiments of the present invention.

Any of the computer systems mentioned herein may utilize any suitable number of subsystems. Examples of such subsystems are shown in FIG. 17 in computer system 90. In some embodiments, a computer system includes a single computer apparatus, where the subsystems can be the components of the computer apparatus. In other embodiments, a computer system can include multiple computer apparatuses, each being a subsystem, with internal components. A computer system can include desktop and laptop computers, tablets, mobile phones and other mobile devices.

The subsystems shown in FIG. 17 are interconnected via a system bus 75. Additional subsystems such as a printer 74, keyboard 78, storage device(s) 79, monitor 76, which is coupled to display adapter 82, and others are shown. Peripherals and input/output (I/O) devices, which couple to I/O controller 71, can be connected to the computer system by any number of means known in the art such as input/output (I/O) port 77 (e.g., USB, FireWire®). For example, I/O port 77 or external interface 81 (e.g. Ethernet, Wi-Fi, etc.) can be used to connect computer system 90 to a wide area network such as the Internet, a mouse input device, or a scanner. The interconnection via system bus 75 allows the central processor 73 to communicate with each subsystem and to control the execution of instructions from system memory 72 or the storage device(s) 79 (e.g., a fixed disk, such as a hard drive, or optical disk), as well as the exchange of information between subsystems. The system memory 72 and/or the storage device(s) 79 may embody a computer readable medium. Another subsystem is a data collection device 85, such as a camera, microphone, accelerometer, and the like. Any of the data mentioned herein can be output from one component to another component and can be output to the user.

A computer system can include a plurality of the same components or subsystems, e.g., connected together by external interface 81 or by an internal interface. In some embodiments, computer systems, subsystem, or apparatuses can communicate over a network. In such instances, one computer can be considered a client and another computer a server, where each can be part of a same computer system. A client and a server can each include multiple systems, subsystems, or components.

It should be understood that any of the embodiments of the present invention can be implemented in the form of control logic using hardware (e.g. an application specific integrated circuit or field programmable gate array) and/or using computer software with a generally programmable processor in a modular or integrated manner. As used herein, a processor includes a single-core processor, multi-core processor on a same integrated chip, or multiple processing units on a single circuit board or networked. Based on the disclosure and teachings provided herein, a person of ordinary skill in the art will know and appreciate other ways and/or methods to implement embodiments of the present invention using hardware and a combination of hardware and software.

Any of the software components or functions described in this application may be implemented as software code to be executed by a processor using any suitable computer language such as, for example, Java, C, C++, C#, Objective-C, Swift, or scripting language such as Perl or Python using, for example, conventional or object-oriented techniques. The software code may be stored as a series of instructions or commands on a computer readable medium for storage and/or transmission. A suitable non-transitory computer readable medium can include random access memory (RAM), a read only memory (ROM), a magnetic medium such as a hard-drive or a floppy disk, or an optical medium such as a compact disk (CD) or DVD (digital versatile disk), flash memory, and the like. The computer readable medium may be any combination of such storage or transmission devices.

Such programs may also be encoded and transmitted using carrier signals adapted for transmission via wired, optical, and/or wireless networks conforming to a variety of protocols, including the Internet. As such, a computer readable medium according to an embodiment of the present invention may be created using a data signal encoded with such programs. Computer readable media encoded with the program code may be packaged with a compatible device or provided separately from other devices (e.g., via Internet download). Any such computer readable medium may reside on or within a single computer product (e.g. a hard drive, a CD, or an entire computer system), and may be present on or within different computer products within a system or network. A computer system may include a monitor, printer, or other suitable display for providing any of the results mentioned herein to a user.

Any of the methods described herein may be totally or partially performed with a computer system including one or more processors, which can be configured to perform the steps. Thus, embodiments can be directed to computer systems configured to perform the steps of any of the methods described herein, potentially with different components performing a respective steps or a respective group of steps. Although presented as numbered steps, steps of methods herein can be performed at a same time or in a different order. Additionally, portions of these steps may be used with portions of other steps from other methods. Also, all or portions of a step may be optional. Additionally, any of the steps of any of the methods can be performed with modules, units, circuits, or other means for performing these steps.

The specific details of particular embodiments may be combined in any suitable manner without departing from the spirit and scope of embodiments of the invention. However, other embodiments of the invention may be directed to specific embodiments relating to each individual aspect, or specific combinations of these individual aspects.

The above description of example embodiments of the invention has been presented for the purposes of illustration and description. It is not intended to be exhaustive or to limit the invention to the precise form described, and many modifications and variations are possible in light of the teaching above.

A recitation of "a", "an" or "the" is intended to mean "one or more" unless specifically indicated to the contrary. The use of "or" is intended to mean an "inclusive or," and not an "exclusive or" unless specifically indicated to the contrary.

All patents, patent applications, publications, and descriptions mentioned herein are incorporated by reference in their entirety for all purposes. None is admitted to be prior art.

What is claimed is:

1. A method for mass analyzing ions in an ion trap, comprising:

(a) confining ions of different mass-to-charge ratios (m/z's) in a trap volume by applying a trapping signal to the ion trap;

(b) mass sequentially ejecting the confined ions to a detector by applying a resonant excitation signal to the ion trap and progressively scanning the trapping signal amplitude over time, wherein at least one of: (i) a scan starting time, (ii) a frequency of the resonant excitation signal or the trapping signal, or (iii) a phase of the resonant excitation signal or the trapping signal, is or are controlled to cause ions of a particular m/z to be ejected in a reproducible pattern of plural micropackets;

(c) generating at the detector a plurality of measurement points extending over a time range, each measurement point representing an intensity of ejected ions detected at a discrete timepoint, at a data acquisition frequency sufficiently high to resolve adjacent micropackets;

(d) determining a linear combination of stored micropacket patterns that approximates the plurality of measurement points, wherein each stored micropacket pattern corresponds to an ion of a particular m/z and wherein the stored micropacket patterns define a repeating sequence over an m/z interval, the stored micropacket patterns including patterns of micropackets at different initial phases which define the phase shift between the trapping signal and the resonant excitation signal; and (e) constructing a mass spectrum based on the determined linear combination of stored micropacket patterns.

2. The method of claim 1, wherein step (c) is performed at a data acquisition frequency of between $2\Omega$ and $4\Omega$, where $\Omega$ is the frequency of the trapping signal.

3. The method of claim 1, wherein the ratio of the frequency $\omega$ of the resonant excitation signal to the frequency $\Omega$ of the trapping signal is ⅓.

4. The method of claim 1, wherein step (b) comprises scanning the trapping signal amplitude over a time period greater than a common cycle period corresponding to the frequencies of the trapping signal and the resonant excitation signal.

5. A mass spectrometer, comprising:

an ion trap having a plurality of electrodes interiorly defining a trap volume;

a trapping signal supply for applying a trapping signal to one or more electrodes of the ion trap;

a resonant excitation signal supply for applying a resonant excitation signal to one or more electrodes of the electrode trap;

a controller, coupled to the trapping signal supply and the resonant ejection signal supply, configured to progressively scan the trapping signal amplitude over time to cause ions confined in the trap volume to be mass sequentially ejected from the ion trap, the controller controlling at least one of i) a scan starting time, (ii) a frequency of the resonant excitation signal or the trapping signal, or (iii) a phase of the resonant excitation signal or the trapping signal to cause ions of a particular m/z to be ejected in a reproducible pattern of plural micropackets;

a detector positioned to receive ions ejected from the ion trap and to responsively generate a plurality of measurement points extending over a time range, each measurement point representing an intensity of ejected ions detected at a discrete timepoint, the detector being operated at a data acquisition frequency sufficiently high to resolve adjacent micropackets;

a data system programmed with instructions for determining a linear combination of stored micropacket patterns that approximates the plurality of measurement points, wherein each stored micropacket pattern corresponds to an ion of a particular m/z and wherein the stored micropacket patterns define a repeating sequence over an m/z interval, and for constructing a mass spectrum based on the determined linear combination of stored micropacket patterns, the stored micropacket patterns including patterns of micropackets at different initial phases which define the phase shift between the trapping signal and the resonant excitation signal.

* * * * *